US009422703B1

(12) United States Patent
Ciotic

(10) Patent No.: US 9,422,703 B1
(45) Date of Patent: Aug. 23, 2016

(54) ODOR-REMOVING HINGE SYSTEM FOR TOILETS AND PORTABLE COMMODES

(71) Applicant: Egor Ciotic, Fair Oaks, CA (US)

(72) Inventor: Egor Ciotic, Fair Oaks, CA (US)

( * ) Notice: Subject to any disclaimer, the term of this patent is extended or adjusted under 35 U.S.C. 154(b) by 204 days.

(21) Appl. No.: 13/694,917

(22) Filed: Jan. 19, 2013

(51) Int. Cl.
*E03D 9/04* (2006.01)
*E03D 9/052* (2006.01)

(52) U.S. Cl.
CPC ..... *E03D 9/052* (2013.01)

(58) Field of Classification Search
CPC ..... E03D 9/052
USPC ..... 4/210–219
See application file for complete search history.

(56) References Cited

U.S. PATENT DOCUMENTS 1,887,498 A * 11/1932 Connors ..... 4/213
2,847,682 A 4/1955 Shay
4,375,704 A * 3/1983 Smith ..... 4/213
5,161,262 A 11/1992 Quaintance, Sr.
6,523,184 B2 * 2/2003 Prisco ..... 4/213
6,779,204 B1 8/2004 Ciotic
7,020,909 B2 4/2006 Ciotic
2003/0177568 A1 * 9/2003 Chasen et al. ..... 4/213
2009/0235442 A1 * 9/2009 Lee ..... 4/217
2010/0071120 A1 * 3/2010 Ghardi et al. ..... 4/217

* cited by examiner

*Primary Examiner* — Huyen Le
*Assistant Examiner* — Christine Skubinna
(74) *Attorney, Agent, or Firm* — Clifford F. Rey

(57) ABSTRACT

An odor-removing hinge system and method of use for withdrawing noxious odors from toilets and portable commodes is disclosed. The present seat hinge system includes an integrated housing that functions as a portion of an exhaust pathway for noxious gases expelled within the toilet bowl. The present hinge system includes at least one hollow bolt disposed in fluid communication with the housing, which is used to secure the toilet seat to the toilet. In one embodiment the noxious gases within the toilet bowl are carried by convection or vacuum via connective tubing to an exhaust conduit installed in an adjacent wall. In other embodiments the noxious gases are directed through a detachable air filter assembly secured to the housing and the odorless filtered air is recirculated. In a method of use the present hinge system is retrofitted to existing toilets and portables commodes in replacement of standard toilet seat hinges.

3 Claims, 24 Drawing Sheets

ODOR-REMOVING HINGE SYSTEM FOR TOILETS AND PORTABLE COMMODES

BACKGROUND OF INVENTION

Field of Invention

The present invention relates to toilets and, more particularly, to an odor-removing hinge system for venting of noxious odors related to the use of both standard (i.e. flush type) toilets and portable commodes.

The use of all common types of toilets produces unpleasant odors. The conventional way to ventilate a bathroom, restroom or other facility containing a toilet is by the use of an exhaust fan often installed in the ceiling of the bathroom, which typically requires about forty to one-hundred-eighty watts of electrical power to operate. In order to remove unpleasant odors, such a ceiling fan must operate for several minutes or longer to remove the entire volume of air within the bathroom and exhaust it to the exterior of the home or other building.

Such conventional exhaust fans are disadvantageous for many reasons. Initially, such ventilating fans use substantial electrical power and, thus, are expensive to operate. When such an exhaust fan is operating there is no specific airflow generated to carry away odors from the area surrounding the toilet or from within the toilet bowl. Thus, such an exhaust fan must remove a substantial volume of air to the exterior of the home or other structure that has either been heated or, alternatively, which has been cooled depending on the locale and weather conditions. Accordingly, the operation of such conventional bathroom exhaust fans is energy inefficient and also generates an unpleasant noise for others in the vicinity.

Another related problem is presented by elderly, infirm and physically disabled persons who may be unable to use a standard toilet and are required to use a portable commode positioned near a bed or in another living area where there is no exhaust fan in proximity to the commode. The odors emanating from a portable commode are more problematic than those associated with a standard toilet because the waste materials cannot be flushed away.

Thus, the present invention has been developed to resolve these problems and other shortcomings of the prior art.

DESCRIPTION OF RELATED PRIOR ART

Toilet ventilation systems are known in the prior art and while the structural arrangements of such systems may, at first appearance, have similarities to the present invention, they differ in material respects. These differences, which will be described hereinafter in further detail, are deemed essential for the effective use of the present invention.

U.S. Pat. No. 6,779,204 filed on Aug. 24, 2004, entitled "Portable Venting Commode," by the same inventor named herein, while different from the present invention, also includes further information that may be helpful in understanding the advantages of the instant invention.

U.S. Pat. No. 7,020,909 filed on Jun. 23, 2004, also entitled "Portable Venting Commode," by the same inventor, while different from the present invention, also includes information that may be helpful in understanding the advantages of the present invention.

U.S. Pat. No. 2,847,682 to Shay filed Apr. 18, 1955, entitled "Toilet Ventilator," discloses a ventilating attachment apparatus for a standard toilet. To install the Shay ('682) apparatus, which includes a floor-mounted duct wherein a blower is installed, the flush tank must be disassembled from the toilet base and the Shay ('682) apparatus interposed between the flush tank and the toilet base. Then the toilet (as modified) must be reassembled using modified parts to accommodate the increased height of the flush tank. Thus, the Shay ('682) apparatus does not provide the ease of installation, automatic operation or the energy efficiency of the present invention.

U.S. Pat. No. 5,161,262 to Quaintance filed on Aug. 22, 1991, entitled "Toilet Odor Removal Apparatus" discloses an apparatus having an adjustable housing which includes a thin air inlet that is disposed adjacent the toilet bowl rim and which communicates with the hollow interior of the housing sections. In one section of the housing are a battery pack, timer circuit, and on-off switches. In the other section are an activated charcoal filter and a fan which draws foul air over the charcoal filter and removing it to the ambient air. However, this apparatus does not disclose the plurality of hinge plate segments of the present system, which interlock in pivoting relation to adjust to toilet seats of different sizes. Further, the Quaintance ('262) apparatus does not disclose a magnetically-actuated switch which operates the fan motor each time the toilet cover is lifted.

While these devices fulfill their respective, particular objectives and requirements, the aforementioned patents do not disclose the present a ventilating toilet seat hinge system for venting of odors that is suitable for use with both standard (i.e. flush type) toilets and portable commodes. The instant invention provides an odor-removing hinge system including an integrated housing that functions as a conduit to automatically exhaust the air and noxious odors that are contained within a toilet bowl cavity or waste receptacle within a portable commode.

SUMMARY OF THE INVENTION

Accordingly, the present invention is an odor-removing hinge system and method of use for venting noxious odors emanating from both standard (i.e. flush type) toilets and portable commodes. The present invention can be utilized in the manufacture of new toilet seats and can be retrofitted to existing toilet seats and portable commodes.

The present system includes an odor-removing hinge assembly for a toilet seat, which is installed in replacement of a standard toilet seat hinge assembly typically used on such toilet seat. The present toilet seat hinge assembly includes an integrated housing that functions as a conduit to exhaust the air and noxious gases that are contained within the toilet bowl. The present hinge assembly includes at least one hollow bolt disposed in fluid (i.e. air) transfer communication with the housing, which functions to secure the toilet seat to the toilet using the preexisting mounting holes located at the back of the toilet rim. Such hollow bolt extends through the toilet seat mounting holes in the conventional manner to secure the toilet seat hinge assembly in position on a standard toilet or portable commode.

In one embodiment of the present invention, the air and noxious gas mixture within the toilet bowl is carried via connective tubing attached to a distal end of the hollow bolt to an exhaust conduit installed in an adjacent wall and flows to the exterior of the building by convection, air pressure or by vacuum created by a brushless fan motor installed in the exhaust conduit. In this embodiment the fan motor is operated by a hand-held radio control device or, alternatively, the fan is actuated automatically by a magnetic switch whenever the toilet cover is raised to the open position. The fan motor can also be operated continuously, if desired, in light of the minimal electric power consumed during operation, which is under one watt of power (i.e. 0.08 amperes×12 Volts=0.96 watts of power).

In another embodiment the air and noxious gas mixture is directed through a detachable air filter assembly, which is attached to a distal end of such hollow bolt and is, thus, disposed in fluid transfer communication with the cavity of the toilet bowl or commode receptacle. The air filter assembly includes an activated charcoal filter cartridge wherein the air and noxious gas mixture is drawn though by a miniature, brushless fan motor. Such miniature, brushless fan motor is powered by a suitable battery pack or, alternatively, is electrically connected to a power source via a direct current (DC) transformer. In this embodiment of the present invention, the fan can be actuated automatically by a magnetic switch whenever the toilet cover is lifted or, in the alternative, the miniature fan can be actuated by remote radio control. It will be noted that the fan motor should not be operated continuously with an air filter assembly attached in order to increase the longevity of the activated charcoal filter cartridge.

In another embodiment the present odor-removing hinge system is utilized in combination with a modified commercial style toilet seat in replacement of a standard commercial toilet seat (i.e. split seat without a seat cover) commonly found in public restrooms and business facilities. In this embodiment an odor-removing hinge system of the present invention is integrally formed within the structure of the commercial toilet seat and may utilize an air filter assembly as described hereinabove or the noxious gases can be vented directly to an exhaust conduit within an adjacent wall.

The present system is also adaptable to a portable commode by use of a novel toilet seat adaptor bracket that is mechanically attached to the preexisting frame of a portable commode. In all other respects the present hinge system functions with the portable commode in the same manner described hereinabove for standard toilet seats.

There has thus been outlined, rather broadly, the important features of the invention in order that the detailed description thereof that follows may be better understood, and in order that the present contribution to the art may be better appreciated. There are additional features of the invention that will be described hereinafter and which will form the subject matter of the claims appended hereto.

Those skilled in the art will appreciate that the conception upon which this disclosure is based may readily be utilized as a basis for the designing of other structures, methods, and systems for carrying out the purposes of the present invention. It is important, therefore, that the claims be regarded as including such equivalent constructions insofar as they do not depart from the spirit and scope of the present invention.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENTS

The following description is presented to enable any person skilled in the art to make and use the present invention, and is provided in the context of a particular application and its requirements.

Figure 1A:
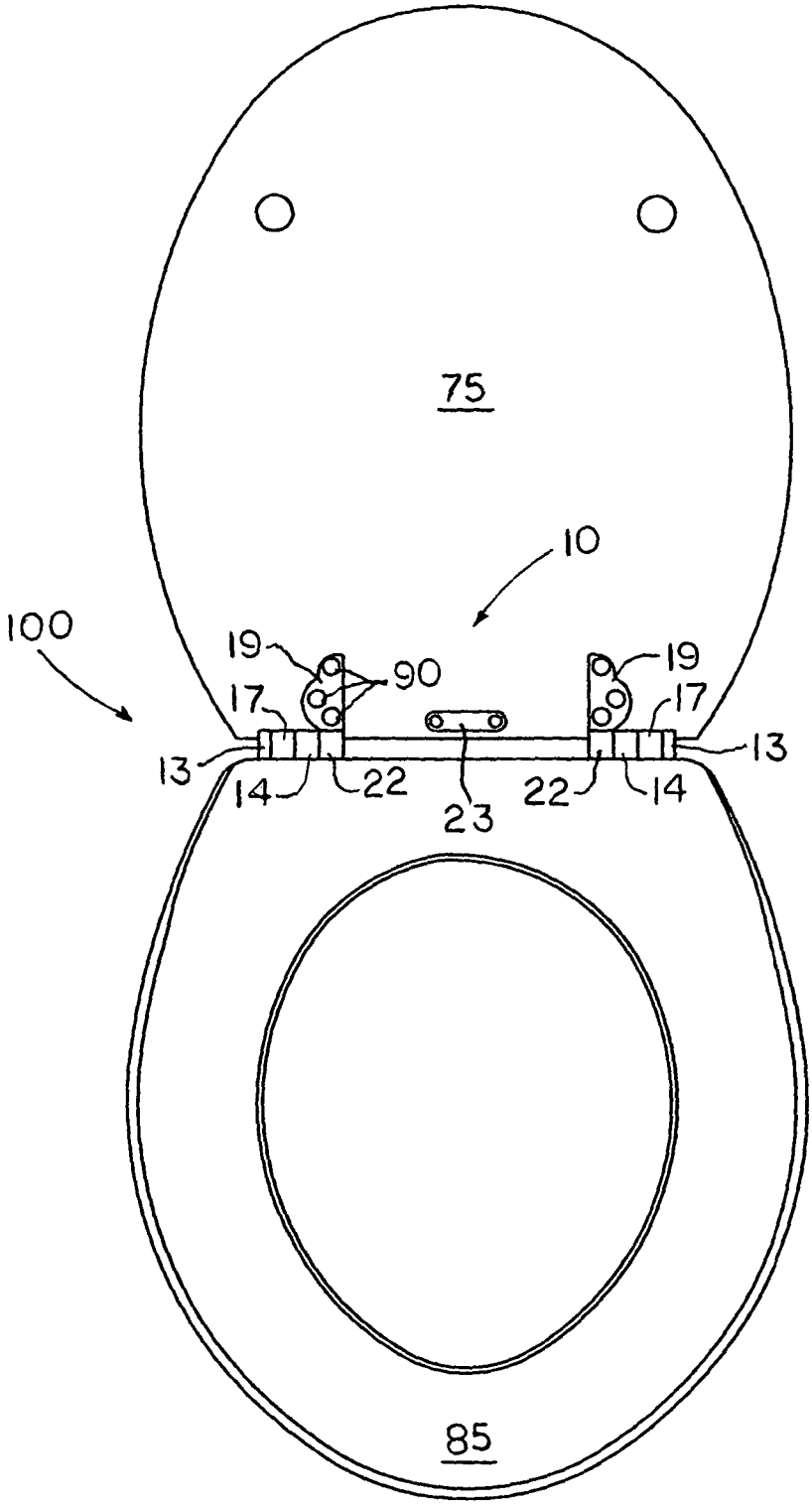
FIG. 1A is a top perspective view of a standard toilet seat made of wood products showing the upper portion of an odor-removing toilet seat hinge assembly of the present invention installed thereon.
Figure 1B:
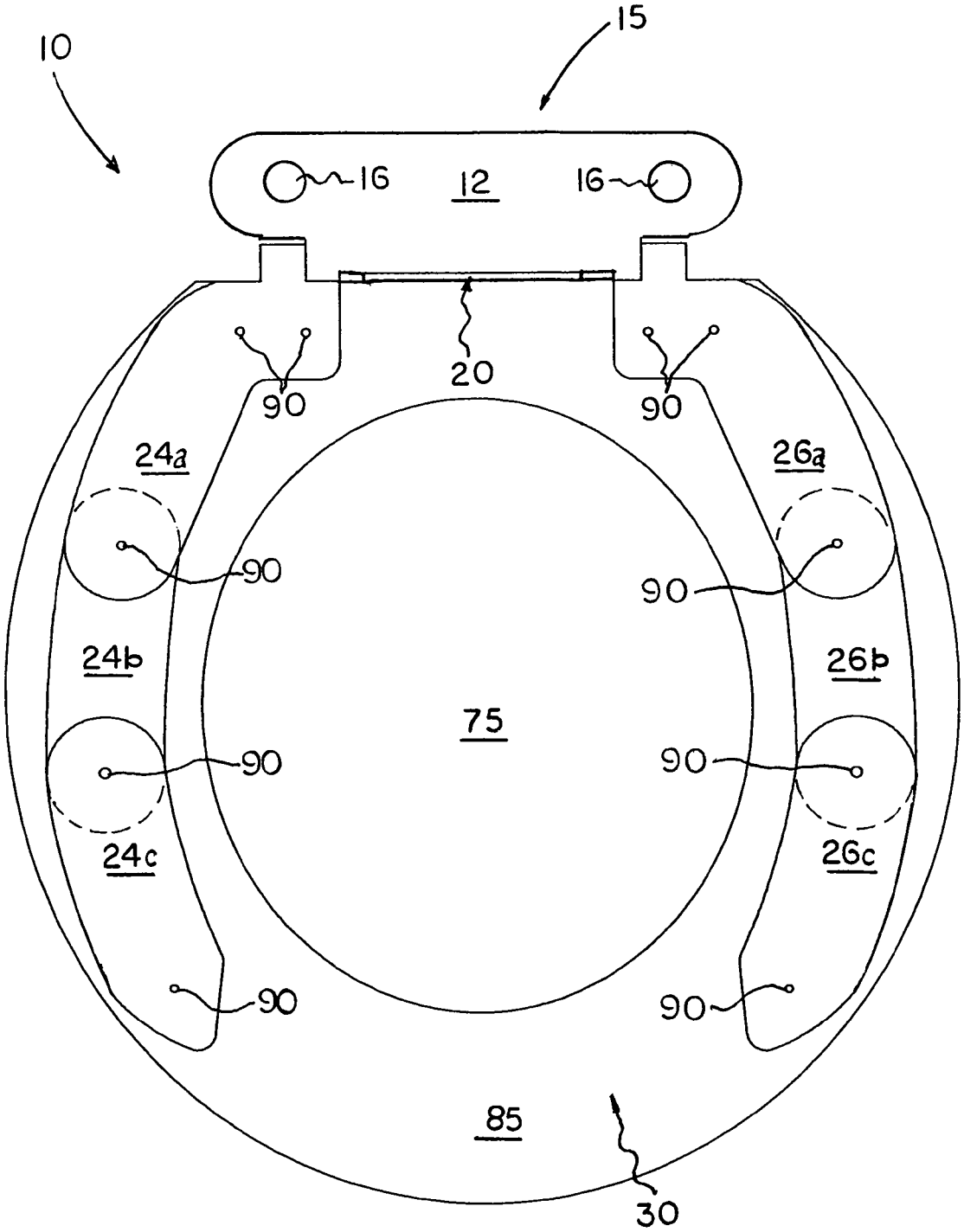
FIG. 1B is a bottom plan view of the lower portion of the present hinge assembly shown mounted on the underside of the toilet seat shown in FIG. 1A.

With further reference to the drawings there are shown therein various embodiments of an odor-removing hinge system for toilets and portable commodes in accordance with the present invention. Referring to FIGS. 1A and 1B there is shown therein a hinge assembly, indicated generally at 10. The present hinge assembly 10 serves to shift the toilet seat cover 75 of a standard toilet seat assembly 100 from an open position (FIG. 1A) to a closed position in which seat cover 75 is disposed in generally parallel relation to the toilet seat 85 (FIG. 4) in a known manner.

In a method of use of the present invention, the toilet seat hinge assembly 10 is installed in replacement of a conventional hinge assembly on a standard wooden toilet seat assembly, indicated generally at 100, including seat cover 75 and toilet seat 85 as described hereinafter in further detail.

In the embodiment shown in FIGS. 1A and 1B, both the toilet seat 85 and the seat cover 75 are fabricated from wood products such as particle board or other engineered, wood particulate material.

Advantageously, hinge assembly 10 includes a plurality of adjustable hinge plate segments 24*a*, 24*b*, 24*c* and 26*a*, 26*b*, 26*c*, which are attached to an underside of toilet seat 85 by fasteners 90 (FIG. 1B). Hinge plate segments 24*a*, 24*b*, 24*c* and 26*a*, 26*b*, 26*c* may be further stabilized by the application of an adhesive to the overlapping end portions thereof (indicated by broken lines) after being fitted to toilet seat 85 as shown in FIG. 1B. Hinge plate segments 24*a*, 24*b*, 24*c* and 26*a*, 26*b*, 26*c*, function to seal the air space between the underside of toilet seat 85 and the toilet rim.

Figure 1C:
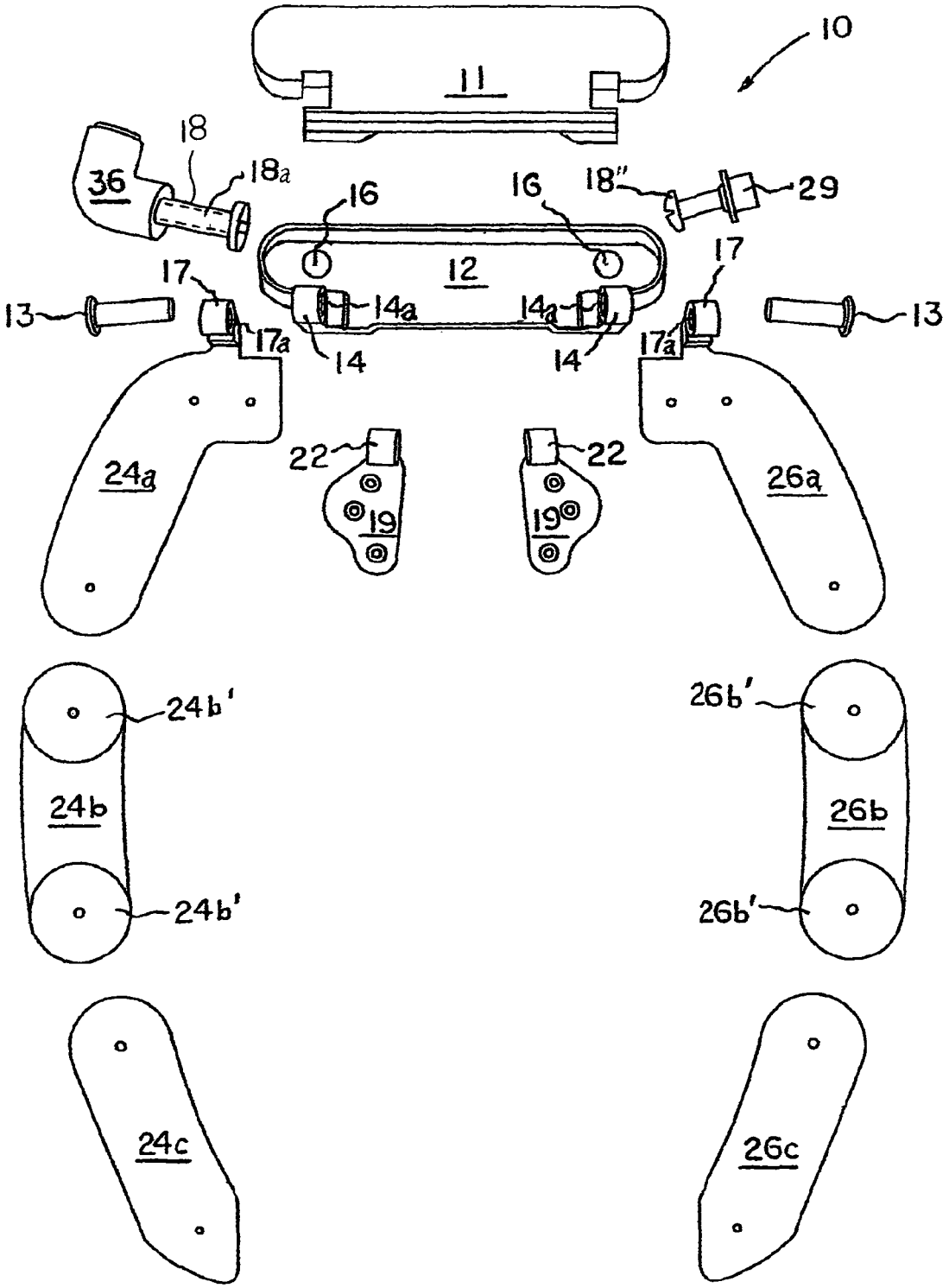
FIG. 1C is an exploded plan view of the present hinge assembly shown in FIGS. 1A and 1B showing the component parts thereof.

Referring now to FIG. 1C there is shown an exploded view of the present hinge assembly 10 showing its component parts in further detail. Hinge assembly 10 comprises a mounting plate 12 whereon housing cover 11 is attached in mating engagement. Mounting plate 12 is provided with mounting holes 16 which receive hollow bolts 18 (FIG. 3A-3B) for attachment of hinge assembly 10 to a standard toilet. Mounting plate 12 also includes a pair of integrally formed hinge pin bosses 14 with hinge pin holes 14*a* extending therethrough for receiving hinge pins 13 in an assembled condition. It can be seen that arcuate plates 24*a*, 26*a* each include integrally formed pin bosses 17 with hinge pin holes 17*a*, which also receive hinge pins 13 in an assembled condition of the hinge assembly 10. Similarly, upper hinge plates 19 include hinge bosses 22 with hinge pin holes (not shown) extending there through for receiving hinge pins 13 in such assembled condition.

Hinge plate segments 24*a*, 24*b*, 24*c* and 26*a*, 26*b*, 26*c* respectively are designed for engagement in interlocking relation with each adjacent hinge plate segment such that the individual segments 24*a*, 24*b*, 24*c* and 26*a*, 26*b*, 26*c* can be mounted on the underside of toilet seat 85 and pivotally adjusted to fit toilet seats 85 of varying sizes. More particularly, segments 24*b*, 26*b* each include a pair of circular pads 24*b*', 26*b*' respectively which interlock and articulate with their adjacent segments 24*a*, 24*c* and 26*a*, 26*c* to shift segments into a desired configuration. Once properly located on the underside of seat 85, hinge plate segments 24*a*, 24*b*, 24*c* and 26*a*, 26*b*, 26*c* are fixed in position by fasteners 90 (FIG. 1B). Hinge plate segments 24*a*, 24*b*, 24*c* and 26*a*, 26*b*, 26*c* may be further stabilized by the application of an adhesive to the circular pads 24*b*', 26*b*' thereof as shown in FIG. 1C prior to final assembly.

It will be appreciated that when installed on the underside of the seat 85, hinge plate segments 24*a*, 24*b*, 24*c* and 26*a*, 26*b*, 26*c* form a non-adhering seal with the top rim of the toilet bowl to effectively prevent the entry or exit of gases from the toilet bowl cavity except for entry via a forward opening as at 30 and exit via opening 20 (FIG. 1B).

Figure 1D:
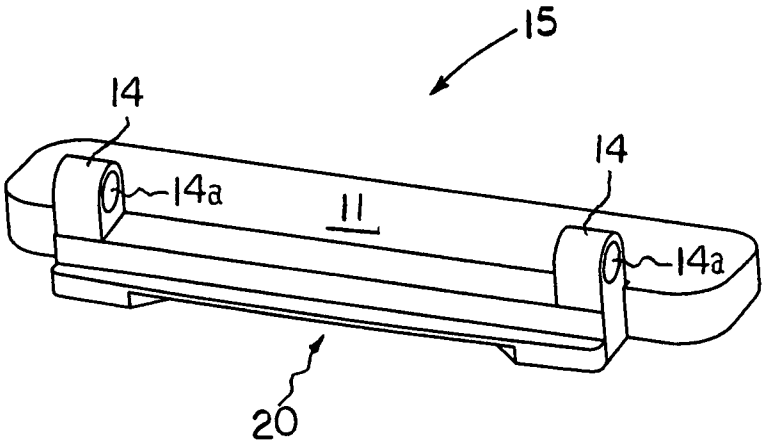
FIG. 1D is a top perspective view of the housing of the toilet seat hinge assembly of the present invention shown in FIGS. 1B and 1C.

As shown more clearly in FIG. 1D, hinge assembly 10 includes a housing, indicated generally at 15, which delineates an opening 20 that functions as a portion of an exhaust conduit to exhaust the air and noxious gases that are contained within the toilet bowl during use. The pathway that air and noxious gases follow when the present hinge assembly 10 is utilized is that ambient air from the bathroom ingresses via front opening 30 (FIG. 1B) into the toilet bowl cavity, mixes with any noxious gases in the toilet bowl cavity, passes through the rear opening 20 into housing 15 (FIG. 1D) and egresses from housing 15 via at least one hollow bolt 18 (FIGS. 3A and 3B), which is disposed in either hole 16 (FIG. 1C) in fluid (i.e. air) transfer communication with the housing. In the case where only a single hollow bolt 18 (FIGS. 3A and 3B) is used, a solid bolt 18" without hole 18*a* is disposed in the opposite hole 16 as shown in FIG. 1C to prevent any noxious gases from escaping.

Figure 2A:
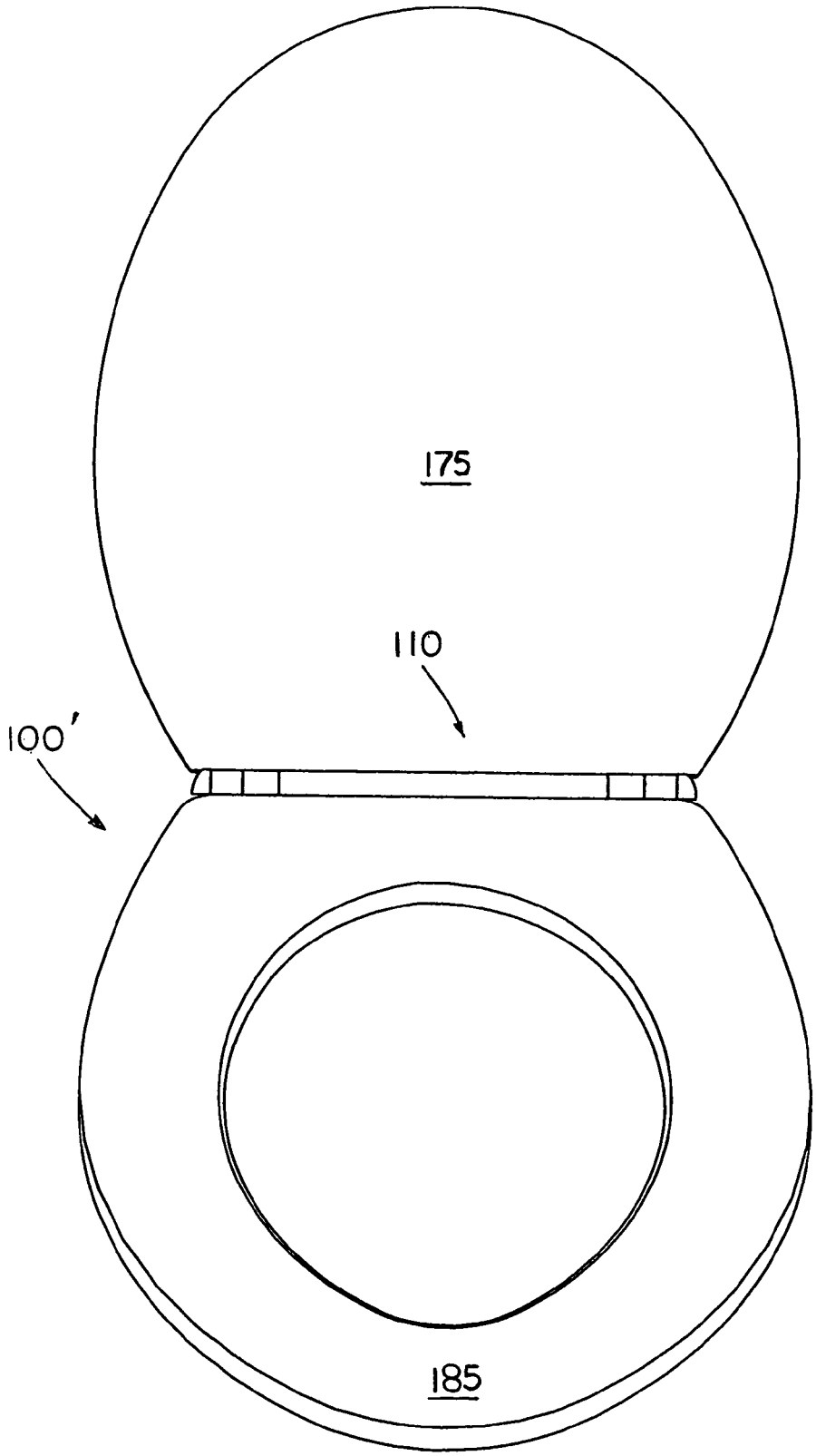
FIG. 2A is a top perspective view of another embodiment of the odor-removing toilet seat hinge assembly of the present invention fabricated from a molded plastic material.

In an another embodiment of the present invention, a modified version of the present toilet seat hinge assembly designed for use with a molded plastic toilet seat, indicated generally at 110, and illustrated in FIGS. 2A to 2C, will now be described. In this embodiment a hinge assembly 110 is fabricated from an engineered plastic such as polyvinylchloride (PVC) or other suitable thermoplastic material by an injection molding process for use in combination with a plastic toilet seat 185 and cover 175. It will be understood that this embodiment of the hinge assembly 110 shown in FIGS. 2A and 2B does not include the plates 19 or arcuate hinge plates 24*a*, 24*b*, 24*c* and 26*a*, 26*b*, 26*c* designed for use with hinge assembly 10 (FIGS. 1A and 1B), wherein seat 85 and seat cover 75 are constructed of particulate wood products.

In nearly all other respects hinge assembly 110 functions in a manner similar to hinge assembly 10. However, the toilet seat hinge assembly 110 is designed to be integrated into a plastic toilet seat assembly, indicated generally at 100', during the manufacture of new plastic toilet seats.

Figure 2B:
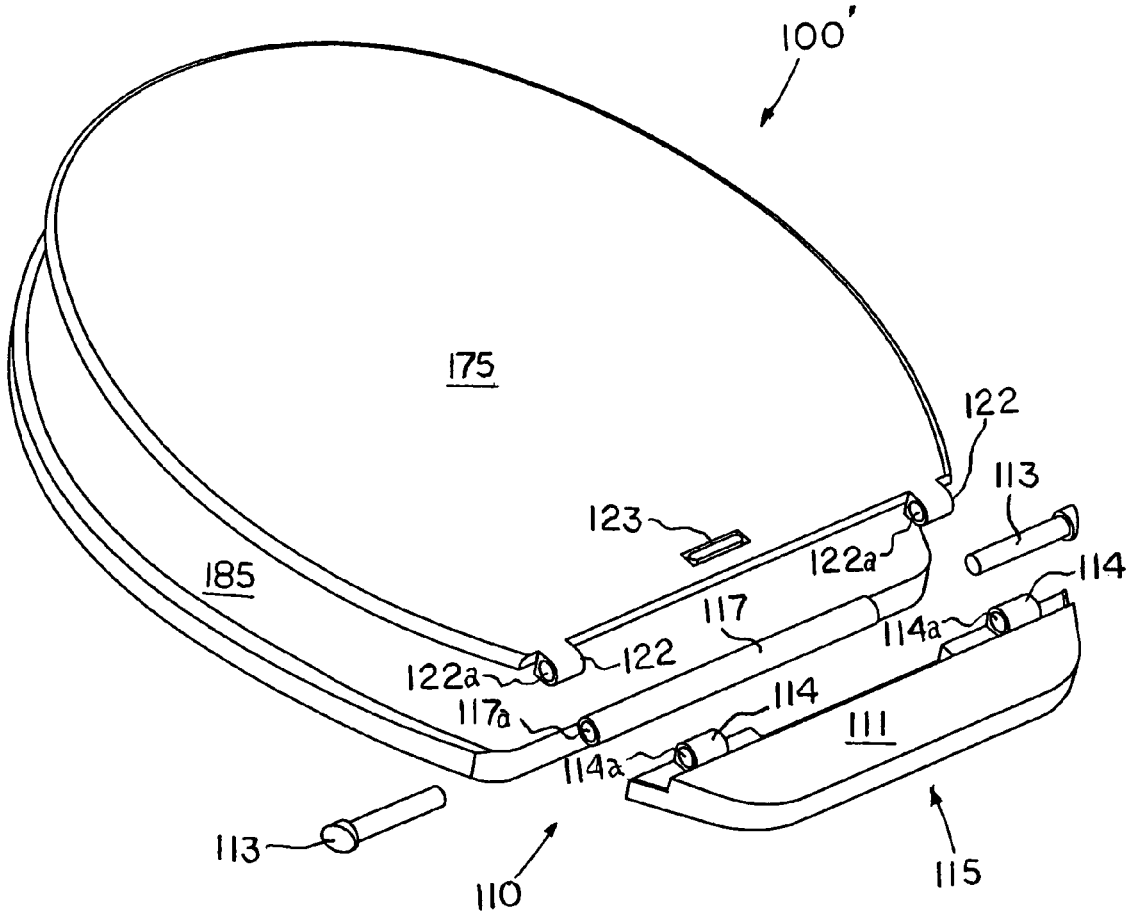
FIG. 2B is an exploded perspective view of the molded plastic toilet seat hinge assembly of FIG. 2A showing further details thereof.

Still referring to FIG. 2B there is shown an exploded view of the present hinge assembly 110 showing its component parts in further detail. Hinge assembly 110 comprises a housing 115 including a mounting plate 112 (FIG. 2C) whereon housing cover 111 is attached in mating engagement. Mounting plate 112 is provided with mounting holes 116 which receive hollow bolts 18 (FIGS. 3A and 3B) for attachment of hinge assembly 110 to a standard toilet Mounting plate 112 includes a pair of integrally formed hinge pin bosses 114 with hinge pin holes 114*a* extending therethrough for receiving hinge pins 113 in an assembled condition.

It can be seen that toilet seat 185 includes an integrally formed hinge pin boss 117 includes a hinge pin hole 17*a*, which also receives hinge pins 113 in an assembled condition of the hinge assembly 110. Seat cover 175 includes integrally formed hinge bosses 122 with hinge pin holes 122*a* extending therethrough for receiving hinge pins 13 in such assembled condition.

When assembled on a toilet or commode, the present hinge assembly 110 pivots about pins 113 to shift the toilet seat cover 175 from an open position (FIG. 2A) to a closed position in which seat cover 175 is disposed in generally parallel relation to the toilet seat 185 (FIG. 5) in a known manner.

Figure 2C:
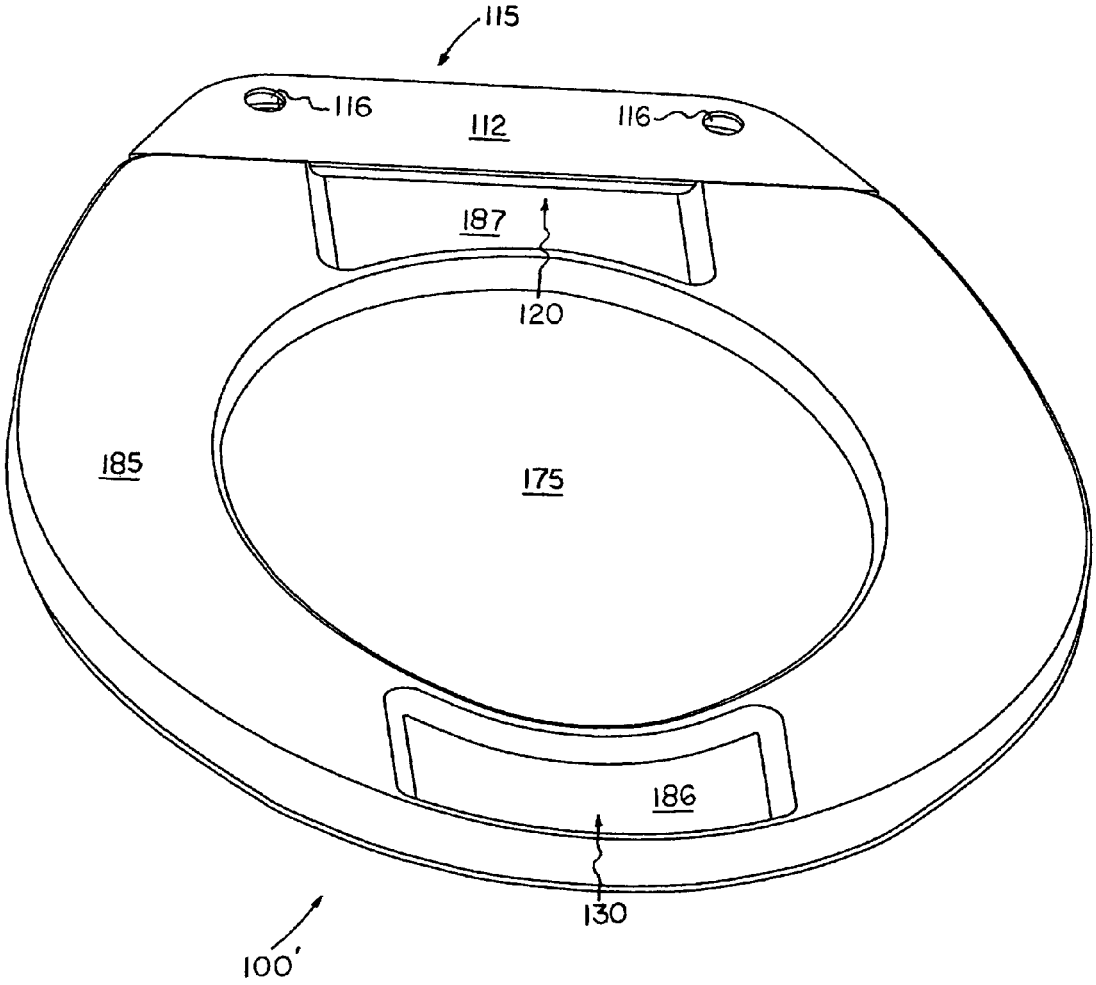
FIG. 2C is a bottom perspective view of the hinge assembly of FIGS. 2A and 2B shown from the underside of the molded plastic toilet seat.

As shown most clearly shown in FIG. 2C, housing 115 comprising housing cover 111 and base plate 112 delineates a rear opening 120 (FIG. 2C) forming part of a pathway to exhaust the air and noxious gases that are contained within the toilet bowl during use.

Still referring to FIG. 2C it will be appreciated that front inlet 186 and a rear outlet 187 are depressions molded into the underside of the seat 185. This effectively prevents the entry or exit of gases from the toilet bowl cavity 40 (FIG. 5) except for entering through front opening 130 defined, in part, by inlet 186 and exiting via rear opening 120 defined, in part, by outlet 187 through opening 120 when installed.

Thus, the pathway that air and noxious gases follow when the present hinge assembly 110 is utilized is that ambient air from the bathroom ingresses via front opening 130 (FIG. 2C) into the toilet bowl cavity, mixes with any noxious gases in the toilet bowl cavity, passes through the rear opening 120 defined by into housing 115 and egresses via at least one hollow bolt 18 (FIGS. 3A and 3B), which is disposed in either hole 116 in fluid (i.e. air) transfer communication with housing 115.

A remote control unit, indicated generally at 70 (FIG. 7B) including a radio transmitter (not shown) of the type manufactured by General Electric (e.g. Model No. 51183T) can be positioned in radio communication with a radio receiver 60 of the type manufactured by General Electric (e.g. Model No. YLT-13-1), which is integrated with fan module 33 (FIG. 4) to provide remote control of the fan motor 54. The portable radio transmitter contained within controller unit 70 includes "ON" and "OFF" switches 71, 72 respectively for remote actuation of the fan motor 54. Since such portable radio receivers and radio transmitters are well known to those skilled in the art, further detailed discussion of the same is not deemed necessary.

Figure 1E:
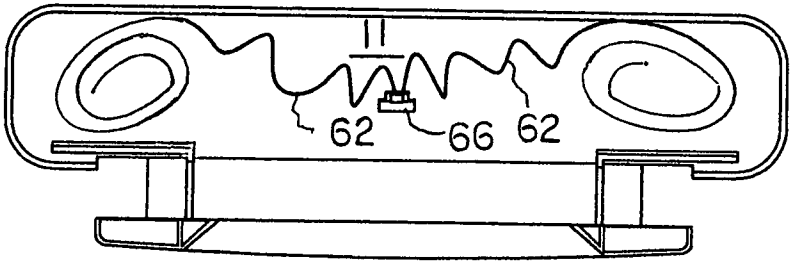
FIG. 1E is a plan view of the interior of the housing cover of FIG. 1D showing details of an optional magnetic switch of the present invention contained therein.
Figure 2D:
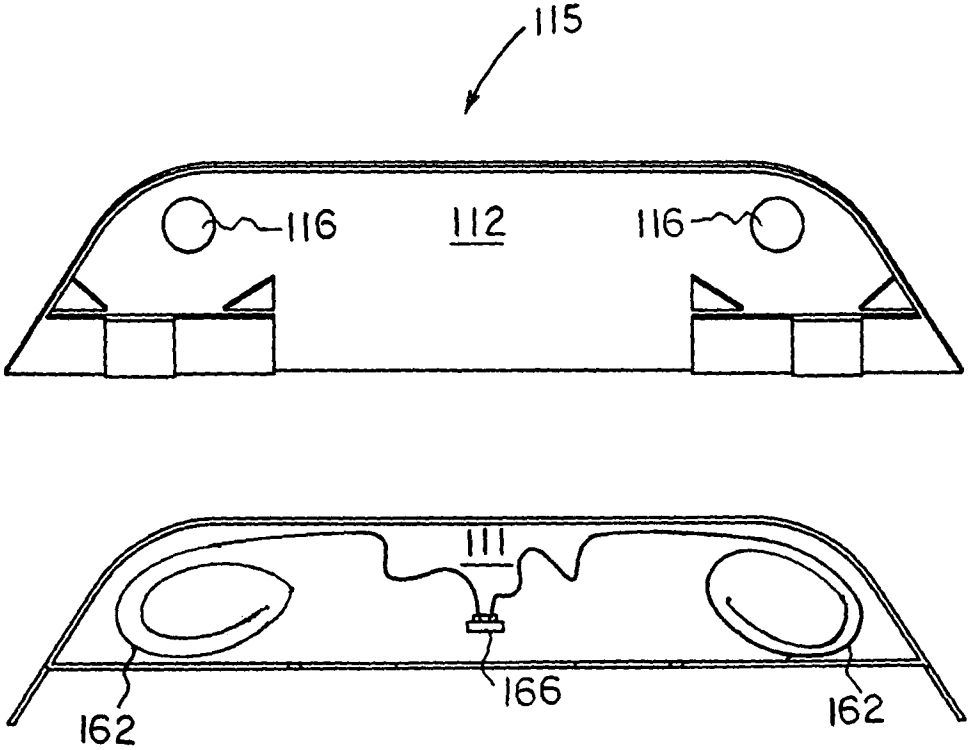
FIG. 2D is a composite plan view of the interior of the housing of FIG. 2B in a disassembled condition showing an optional magnetic switch contained therein.

In alternative embodiments of the present hinge system (FIGS. 4 and 5), hinge assemblies 10, 110 may include a permanent magnet 23, 123 installed on seat covers 75, 175 (FIGS. 1A and 2B), which function to actuate an optional magnetic switch 66, 166 contained within housings 15, 115, 115' (FIGS. 1E, 2D and 10B) respectively to automatically operate fan motor 54 whenever a seat cover 75, 175 is placed in a raised position (FIGS. 1A and 2A) as described hereinafter in further detail.

Figure 3A:
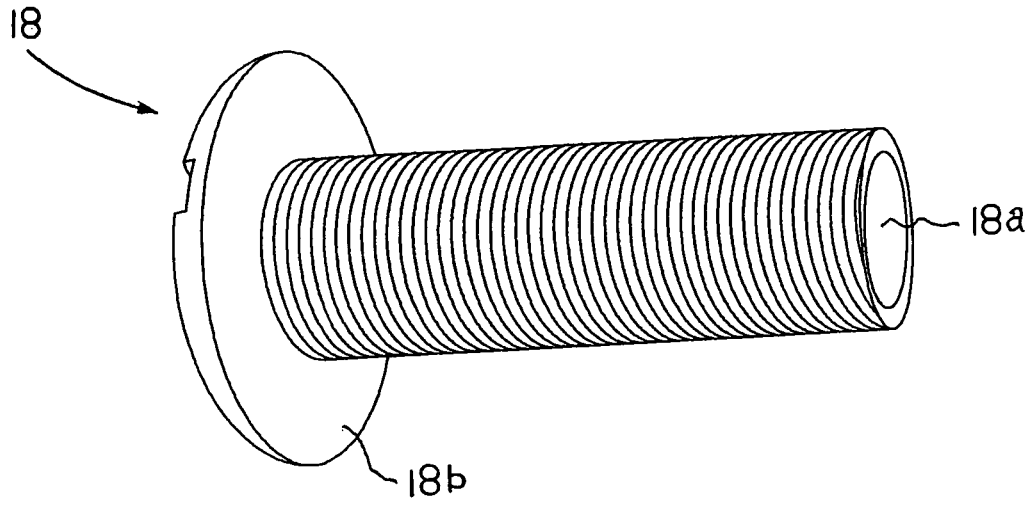
FIG. 3A is a perspective view showing details of a hollow bolt used to secure the present hinge assembly to a toilet base.
Figure 3B:
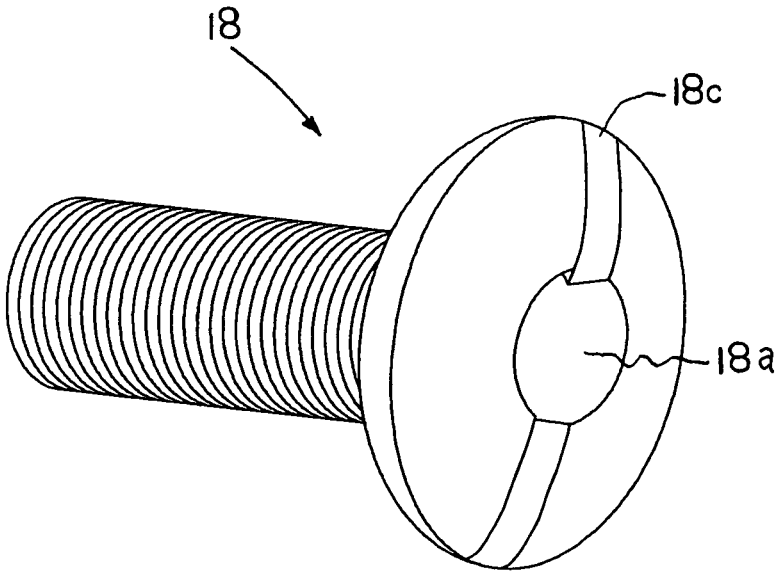
FIG. 3B is a perspective view showing details of the hollow bolt of FIG. 3A rotated 180° from the position shown in FIG. 3A.
Figure 3C:
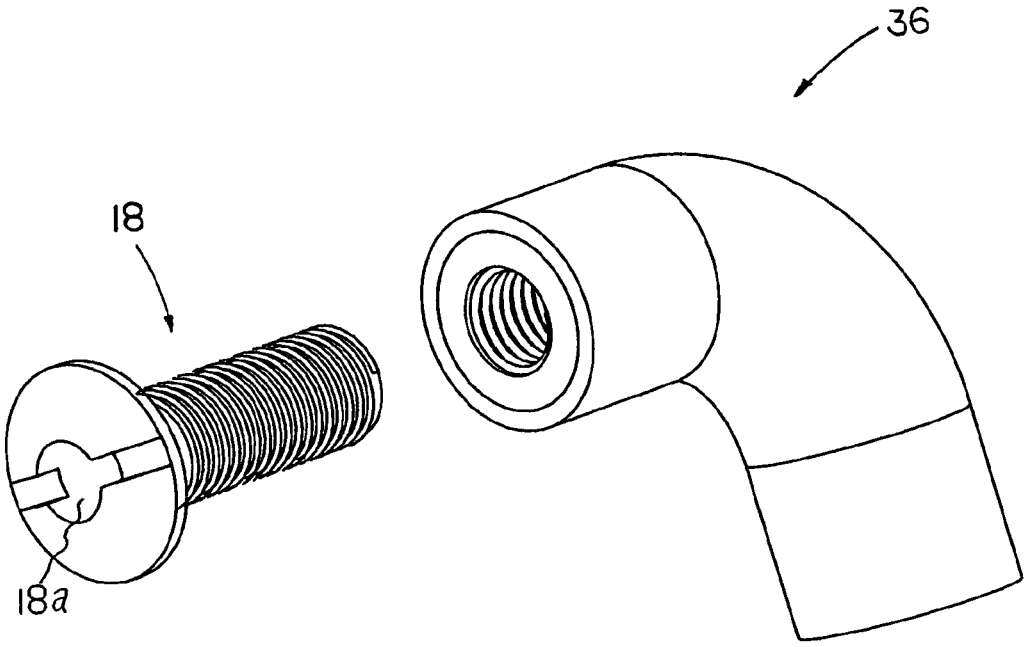
FIG. 3C is a composite perspective view showing details of a hollow bolt in combination with a mating elbow fitting used to secure the present hinge assembly to a toilet base.
Figure 3D:
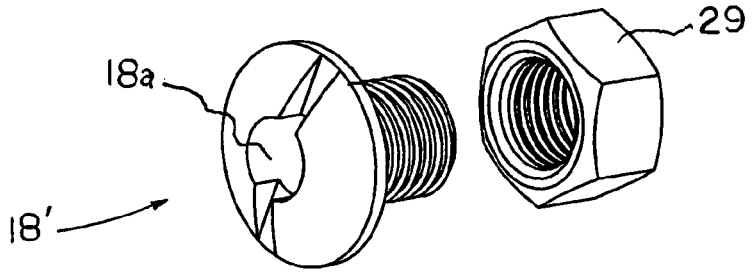
FIG. 3D is a composite perspective view showing details of a modified hollow bolt in combination with a mating nut for attachment of the present hinge system to an adapter bracket of the present invention.

As shown in FIGS. 3A to 3C bolts 18 have a center bore 18*a* and a generally flat head 18*b* with a slot 18*c*, but may be of any length or configuration suitable for attaching hinge assemblies 10, 110 to a standard toilet. A shorter version of hollow bolt 18, namely bolt 18' (FIG. 3D), is fabricated from plastic to act as an insulator and is provided for attachment of hinge assemblies 10, 110 to a seat adapter bracket 125 (FIG. 10A) as described hereinbelow. Bolts 18 may also be provided with a threaded elbow fitting 36 or coupling 269 (FIG. 14) to secure the present hinge assemblies 10, 110 to a standard toilet (FIG. 4).

In such an embodiment of the hinge assemblies 10, 110 which utilize a threaded elbow fitting 36 (FIG. 4), air and noxious gases from the toilet bowl 40 are carried via connective tubing 32 (as shown by directional arrows 73), which extends from a distal end of at least one hollow bolt 18 attached to the mating elbow fitting. Tubing 32 is received in fan module 33 installed in an adjacent bathroom wall 31 as shown in FIG. 4. A flexible, vinyl tubing 32 having a one-half inch inside diameter (ID) is suitable for this purpose.

A miniature exhaust fan 54 disposed within fan module 33 directs the air and noxious gas mixture to the exterior of the building via an exhaust conduit 45, which can also be made from a one-half inch vinyl tubing or other suitable material. Such an embodiment of the exhaust conduit 45 (FIG. 4) made from a one-half inch vinyl tubing is simple to install and economical in comparison to a conventional expandable metal or plastic exhaust duct, which is commonly 3"-4" inside diameter.

Figure 4:
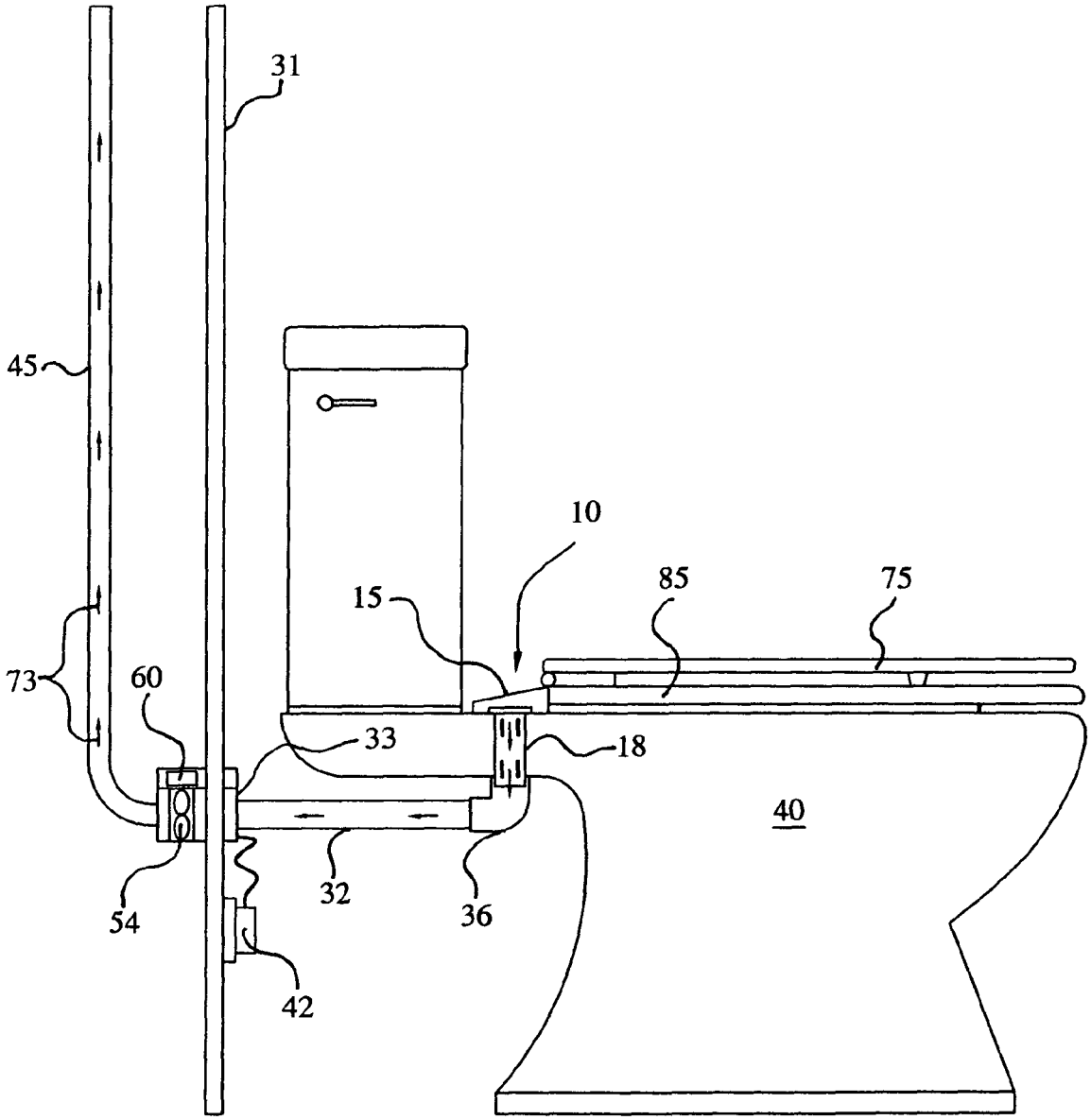
FIG. 4 is a side elevation view of the embodiment of the present toilet seat hinge system shown in FIGS. 1A and 1B mounted on a toilet showing the component parts thereof.

The embodiment of the exhaust conduit 45 shown in FIG. 4 is suitable for use with a standard toilet seat 85 and cover 75 of wood particulate construction (FIGS. 1A and 1B) as shown, or alternatively, can be utilized with a molded plastic toilet seat 185 (FIGS. 2A and 2B) or a modified commercial toilet seat 285 (FIGS. 6 and 14) described hereinbelow.

Still referring to FIG. 4 brushless fan motor 54 receives power for its operation via a power supply 42 electrically connected with the fan motor that converts alternating current (AC) supplied by the residential electrical system into direct current (DC) as required to operate the fan motor. A brushless fan motor 54 of the type manufactured for use in cooling laptop computers, for example, which operates at less than 1.0 watts of power (i.e. 0.08 amps×12 Volts=0.96 watts of power) is suitable for this application. The use of such a brushless fan motor 54 represents a substantial power savings in comparison to operating a conventional bathroom exhaust fan, which requires about 40 to 180 watts of power. In practice this represents a 4,000% to 18,000% reduction in electrical energy use in comparison to operating a conventional bathroom exhaust fan.

Figure 14:
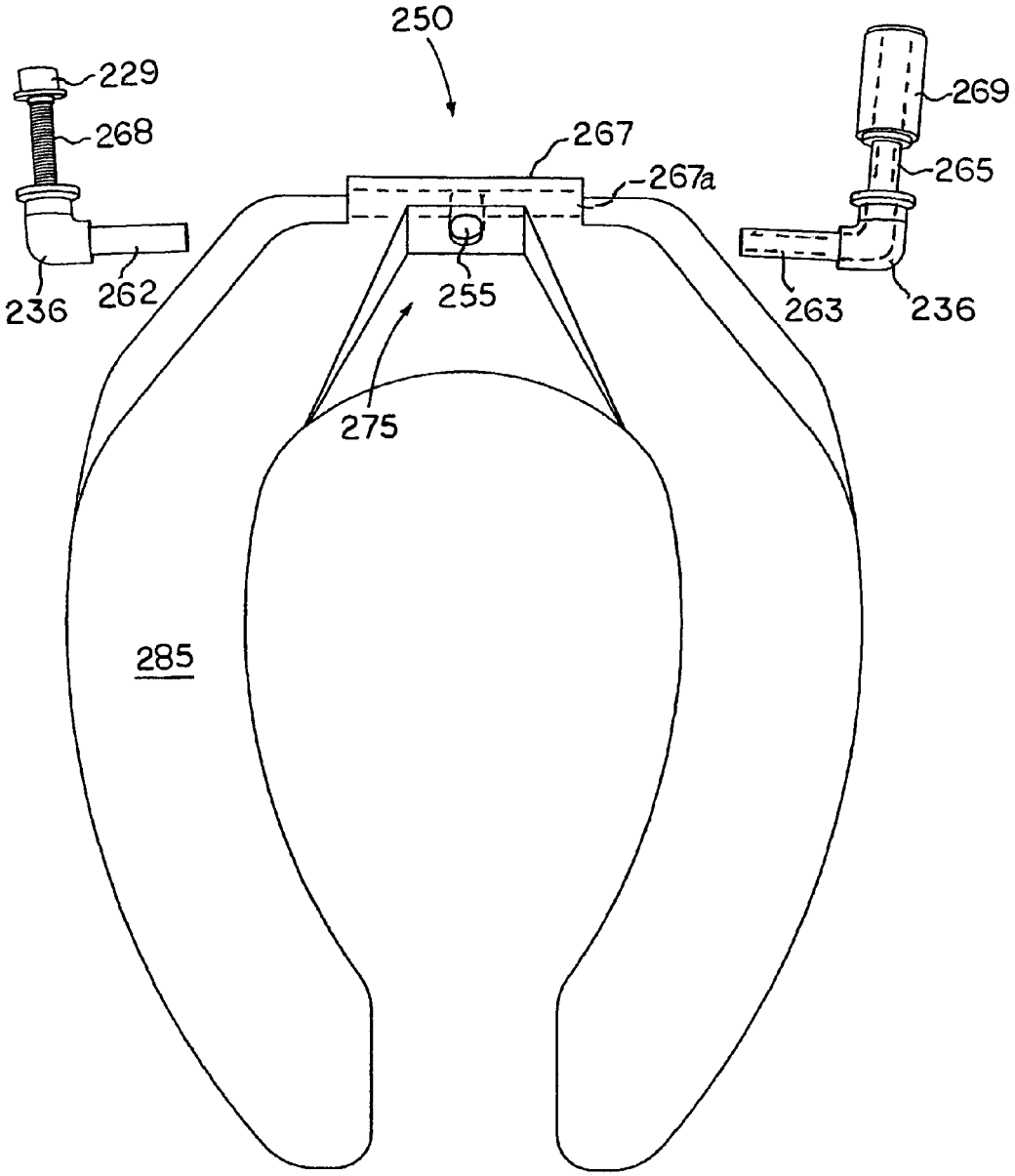
FIG. 14 is an exploded, bottom plan view of another embodiment of a toilet seat hinge assembly in accordance with the present invention for commercial toilet seat applications.

The present invention also includes air filtering means including, but not limited to, the following structures. In another embodiment of the present invention shown in FIG. 5, the air and noxious gas mixture is directed through a detachable air filter assembly, indicated generally at 50. The embodiment in FIG. 5 is shown with a thermoplastic toilet seat (FIGS. 2A to 2C, but is also suitable for use with a toilet seat 85 and cover 75 of wood particulate construction (FIGS. 1A and 1B) as well or, alternatively, with a modified commercial toilet seat 285 (FIG. 14).

Filter assembly 50 (FIG. 5) is connected to an underside of the toilet rim with a hollow bolt 18 by threading engagement as shown. Filter assembly 50 comprises an enclosure 52 which contains an activated charcoal filter element 55, a miniature brushless fan motor 54 including an optional a radio control switch 60, and a battery pack 65 as more clearly shown in FIG. 7A. All electronic components within the filter assembly 50 are electrically interconnected by wiring 63 to an adjustable timer 61 to control the operating time of the fan motor 54 if seat cover 75 is inadvertently left open after use of the toilet to extend the life of the filter element 55.

Figure 5:
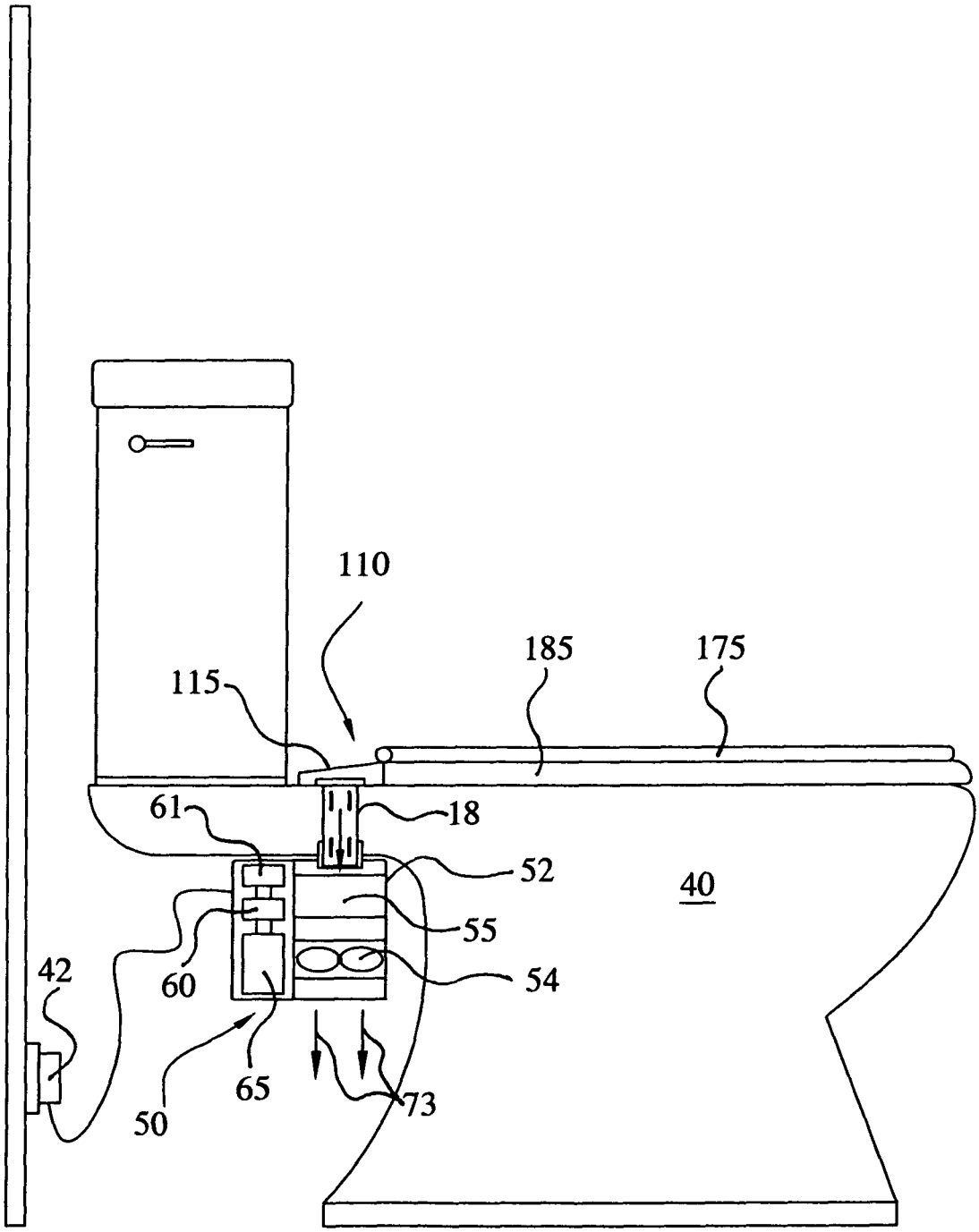
FIG. 5 is a side elevation view of the embodiment of the present toilet seat hinge system shown in FIGS. 2A through 2C mounted on a toilet showing the component parts thereof.

In one embodiment of the filter assembly 50 shown in FIG. 5, fan motor 54 receives power for its operation from a power supply 42 electrically connected via coaxial power jack 69

(FIG. 7A) that converts AC supplied by a residential electrical system into DC as required to operate the brushless fan motor.

An optional radio control transmitter (not shown) within a remote control unit, indicated generally at 70 (FIG. 7B) is positioned in radio communication with radio switch 60 within filter assembly 50 to provide remote control of the fan motor 54. A radio receiver switch 60 of a type marketed by General Electric (e.g. Model No. YLT-13-1) for use with a radio transmitter unit of a type marketed by General Electric (e.g. Model No. 51183T) is suitable for this purpose. Such portable radio transmitter within controller unit 70 (FIG. 7B) includes "ON" and "OFF" switches 71, 72 respectively for remote actuation of the fan motor 54 to utilize the filter assembly 50. Filtered air is delivered from filter assembly 50 into the ambient bathroom air as shown by directional arrows 73 (FIG. 5) producing no perceptible odor.

As described herein hinge assemblies 10, 110, 110' may also include permanent magnets 23, 123 installed on seat covers 75, 175 (FIGS. 1A and 2B) which function to actuate a magnetic switch 66, 166 enclosed within housings 15, 115, 115' (FIGS. 1E, 2D and 12) respectively to operate fan motor 54 with a power supply 42 or, alternatively, in a battery-powered mode whenever either seat cover 75, 175 is raised to an open position.

In such battery-powered mode fan motor 54 receives power for its operation solely from battery pack 65 (FIG. 7A) which is electrically connected to a magnetic switch 66, 166 located in housings 15, 115 respectively via wiring 62, 162 and the power supply 42 is unplugged from coaxial jack 69. In this operational mode switches 66, 166 (FIGS. 1E and 2D) are turned to an "ON" position whenever toilet cover 75, 175 is raised to its open condition (FIGS. 1A and 2A) by a user. In the open condition of the cover 75, 175, a permanent magnet 23, 123 and its surrounding magnetic field is shifted into the functional range of a switch 66, 166, which passes current through the switch and automatically actuates fan motor 54. Thereafter, when cover 75, 175 is closed, permanent magnet 23, 123 its magnetic field is shifted out of functional range relative to switch 66, 166, which is then returned to an "OFF" position and automatically shuts off the fan motor 54.

Figure 7B:
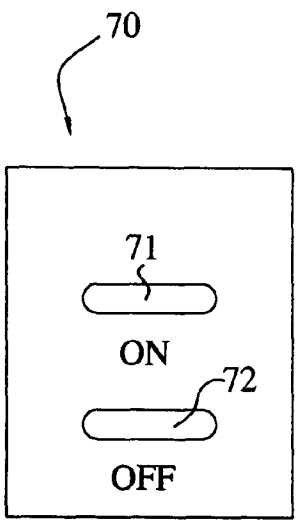
FIG. 7B is a plan view of a remote control device for use in conjunction with the filter assembly shown in FIG. 7A.
Figure 7A:
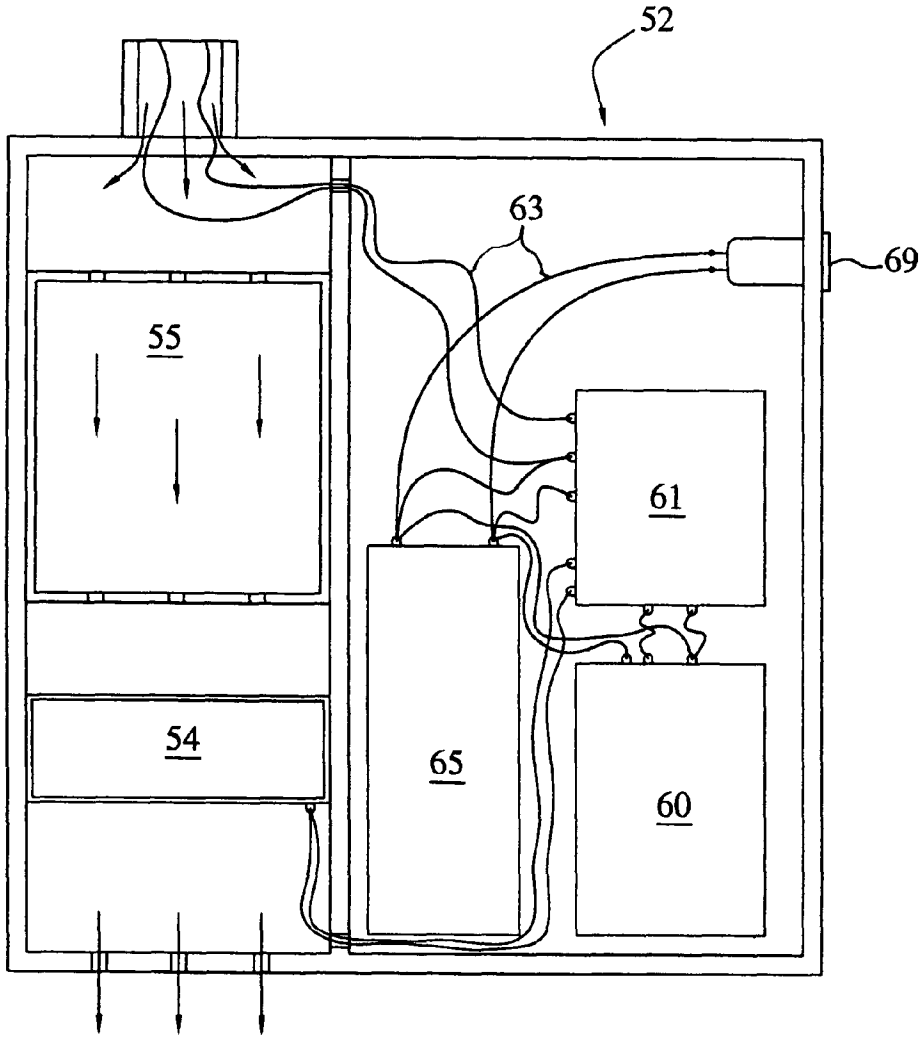
FIG. 7A is an enlarged side elevation view of the filter assembly shown in FIGS. 5 and 6.

In the embodiment shown in FIG. 7A, wiring 62, 162 extends from switches 66, 166 (FIGS. 1E and 2D) into enclosure 52 of the air filter assembly 50 via bore 18*a* of bolt 18 and are electrically connected to fan motor 54 via timer 61. Timer 61 operates fan motor 54 for a predetermined period of time in the event that cover 75 is not returned to its closed condition to extend the useful life of the charcoal filter element 55.

Figure 8B:
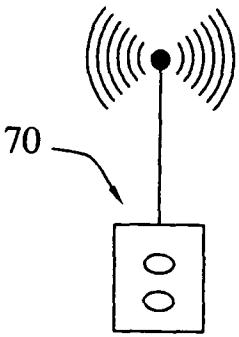
FIG. 8B is an electrical diagram depicting the remote control unit for the filter assembly illustrated in FIG. 7B.
Figure 8A:
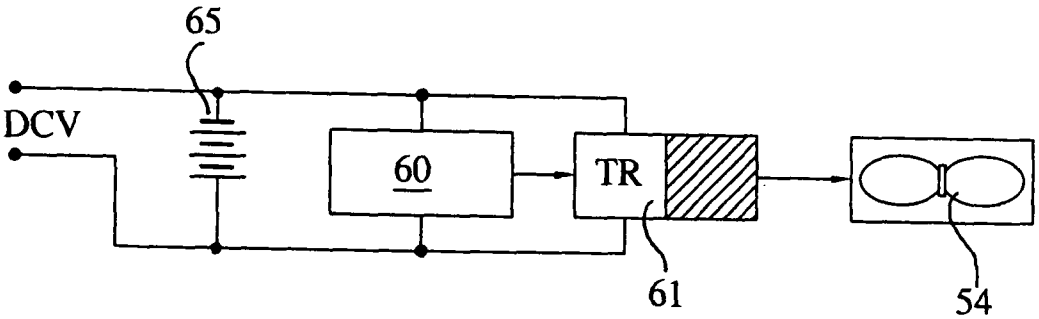
FIG. 8A is an electrical schematic depicting the components and circuitry of the filter assembly illustrated in FIG. 7A.

FIGS. 8A and 8B are a composite electrical schematic/diagram depicting the components and circuitry described hereinabove in relation to FIGS. 7A and 7B hereinabove.

Referring back to FIG. 6 there is shown still another embodiment of a filter assembly, indicated generally at 50', for use with a modified commercial toilet seat 285 (FIG. 14). In this embodiment filter assembly 50' comprises an enclosure 52' which is free-standing and typically resides on the floor or can be mounted on a wall adjacent the toilet or portable commode. It will be appreciated by those skilled in the art that filter assembly 50' may also be utilized with hinge assemblies 10, 110 (FIGS. 4 and 5).

Filter assembly 50' contains an activated charcoal filter element 55' and a miniature fan motor 54' similar to the components described hereinabove in relation to FIGS. 4 and 5. Fan motor 54' receives power for its operation from a power supply 42 electrically connected with the fan 54' that converts AC supplied by a residential electrical system into DC to operate the fan motor as described hereinabove.

An optional radio receiver switch 60 of the type described hereinabove and marketed by General Electric (Model No. YLT-13-1) for use with a radio transmitter unit contained within a remote controller unit 70 (FIG. 7B) is also suitable for this application. A radio transmitter unit (not shown) marketed by General Electric (Model No. 51183T) is also suitable for use in this embodiment. Filtered air is delivered into the ambient air within the bathroom (as shown by directional arrows 73) producing no perceptible odor as described hereinabove.

Figure 9:
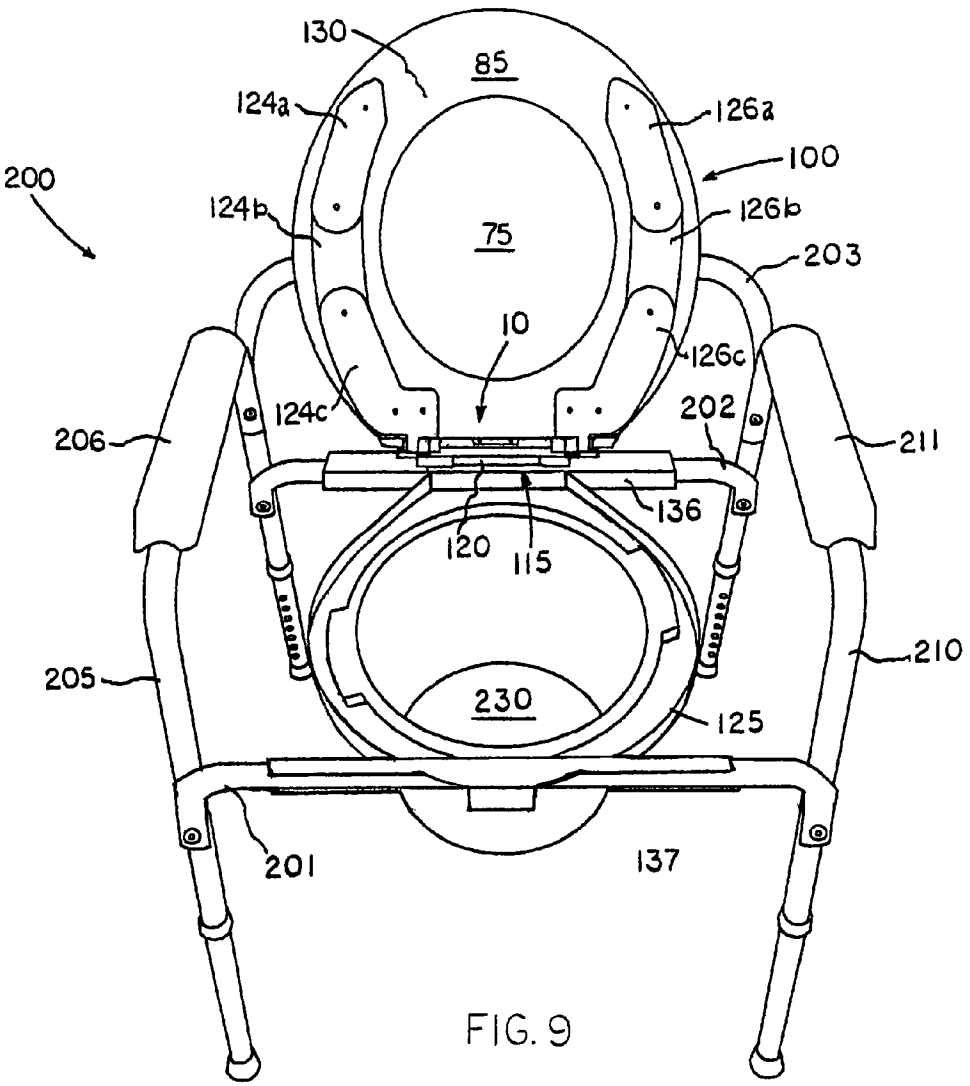
FIG. 9 is a perspective view of the present toilet seat hinge assembly of FIGS. 1A and 1B installed on a portable commode.

The use of the present hinge system in combination with a portable commode will now be described. Referring to FIG. 9 there is shown a portable commode, indicated generally at 200, of the stand-alone type for use near a bed or in another living area where there is no exhaust fan in proximity to the commode.

Portable commode 200 is comprised of a tubular support frame including a pair of U-shaped frame members 205, 210 having adjustable legs for changing the vertical height thereof in a known manner. Frame members 205, 210 are provided with arm rests 206, 211 respectively. Frame members 205, 210 are interconnected by a front cross member 201, a lower rear cross member 202 and an upper rear cross member 203, which are mechanically attached to frame member 205, 210 by suitable fasteners to impart stability to the commode 200.

Portable commode 200 can be utilized with a wood particulate toilet seat assembly, indicated generally at 100, in combination with the present hinge assembly 10 as shown in FIG. 9. The pathway that air and noxious gases follow when the present hinge assembly 10 is utilized is that ambient air from the bathroom ingresses via front opening 130 (FIG. 9) into the waste receptacle 230, mixes with any noxious gases in the waste receptacle, passes through the rear opening 120 into housing 115 and egresses from housing 115 via at least one hollow bolt 18 (FIGS. 3A and 3B), which is disposed in either hole 16 (FIG. 1B) in fluid (i.e. air) transfer communication with the housing.

Alternatively, portable commode 200 can be utilized with the present toilet seat hinge assembly, indicated generally at 110, as shown in FIG. 2B or with a modified commercial toilet seat 285 (FIG. 14). In such embodiment hinge assembly 110 including seat 185 and cover 175 are fabricated from an engineered plastic such as polyvinylchloride (PVC) or other suitable thermoplastic material by an injection molding process.

Figure 10A:
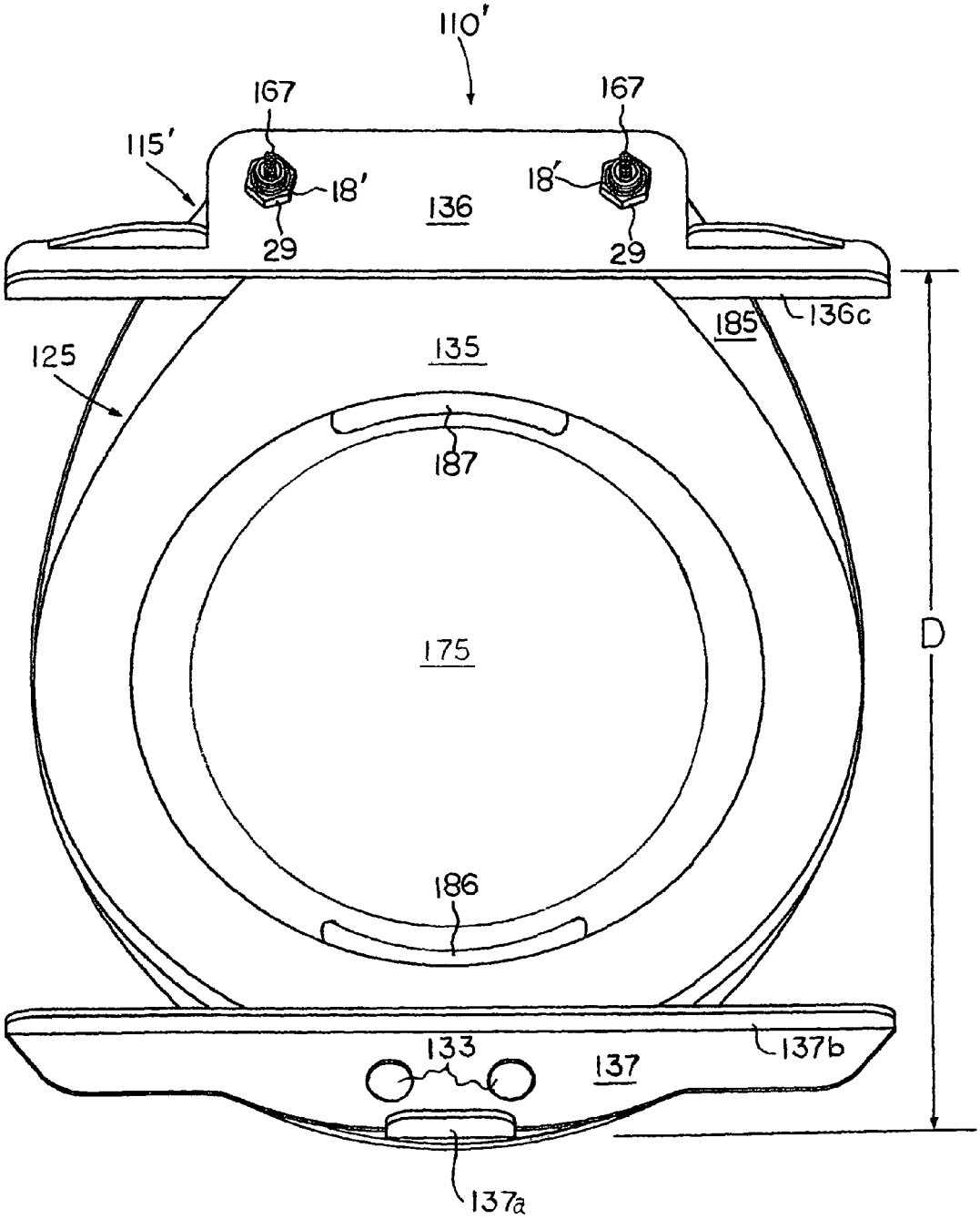
FIG. 10A is a bottom plan view of the toilet seat hinge system of FIG. 2C including a seat adapter bracket installed thereon.

Referring now to FIG. 10A there is shown another embodiment of the present hinge assembly 110' that further includes a seat adapter bracket, indicated generally at 125, which engages front cross member 201 and lower rear cross member 202 of portable commode 200 to properly position the seat 185 above the receptacle 230 for use. It will be appreciated that when hinge assembly 110' is utilized with seat adapter bracket 125, seat 185 rests directly on the top surface of the bracket 125. Adapter bracket 125 is shown (FIG. 10A) in its assembled condition attached to hinge assembly 110', toilet seat 185 and cover 175 by hollow bolts 18' protruding through mounting holes 116' (FIG. 11A) formed in bracket 136 and each bolt 18' is secured by a nut 29. In the embodiment shown in FIG. 10A, bolts 18' are made of plastic, which material functions as an electrical insulator.

Figure 10B:
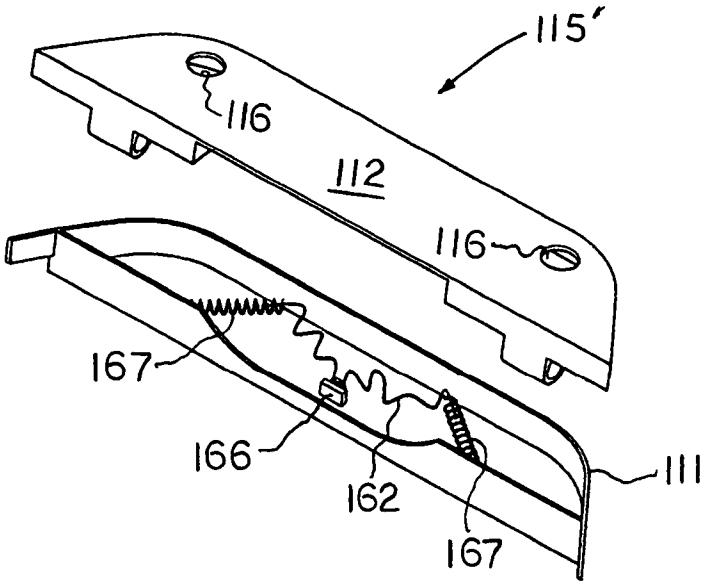
FIG. 10B is an exploded perspective view of the housing shown in FIG. 2B showing details of another embodiment of an optional magnetic switch of the present invention installed within the interior of the housing cover.

Referring to FIG. 10B it will be appreciated by those skilled in the art that an optional magnetic switch 166 is electrically connected via wiring 162 to compression springs 167 that protrude through the bore 18*a* of each shortened bolt 18' (FIG. 10A), which are installed within holes 116' of bracket 125 to provide electrical connection to the filter assembly 150 (FIG. 13) as described in further detail hereinbelow.

It will be understood that a front inlet 186 and a rear outlet 187 are molded into the underside of the seat 185 (FIG. 10A) as described hereinabove in relation to FIG. 2C. This effectively prevents the entry or exit of gases from the receptacle 230 except for entering through front inlet 186 via holes 133 and exiting via rear outlet 187 to an opening 120 when installed.

Thus, the pathway that air and noxious gases follow when the present hinge system 110' (FIG. 10A) is utilized is that ambient air ingresses via front inlet 186 through vent holes 133 into receptacle 230, mixes with any noxious gases in receptacle 230, passes through the rear outlet 187 into housing 115' (FIG. 10B) and egresses via at least one hollow bolt 18', which is disposed in fluid (i.e. air) transfer communication with housing 115'.

Figure 11A:
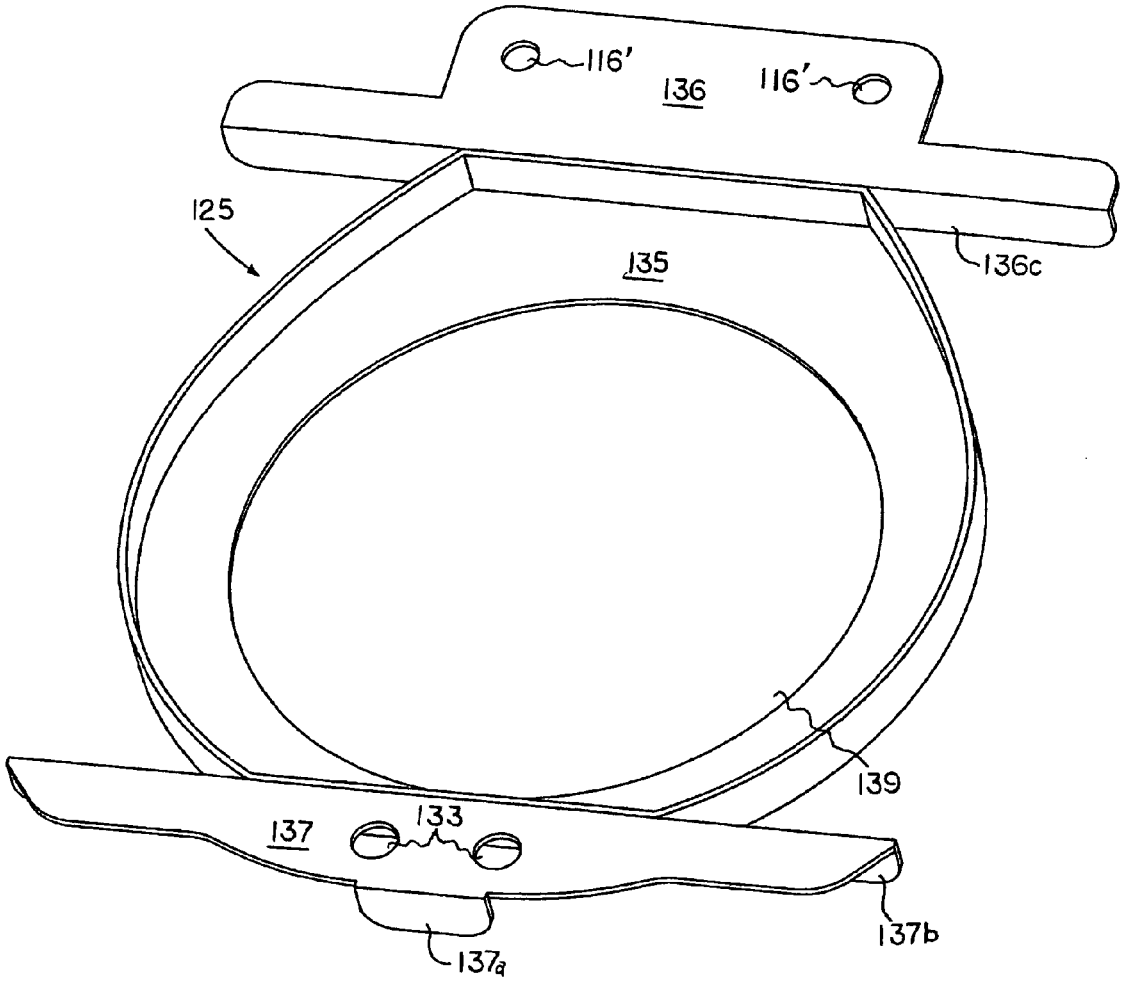
FIG. 11A is a top perspective view of the seat adapter bracket of FIG. 10A showing further details thereof.

Referring now to FIG. 11A there is shown an adapter bracket 125 removed from commode 200 showing further details thereof. Adapter bracket 125 is comprised of a generally oval-shaped basin plate 135 having a circular opening 139 that is configured to receive a basin or receptacle 230 (FIG. 9). Plate 135 includes a rearward extension bracket, indicated generally at 136, and a forward extension bracket, indicated generally at 137, integrally formed with and disposed in generally parallel relation to plate 135. In a preferred embodiment at least rearward extension bracket 136 and, alternatively, the entire plate 135 is fabricated from a ferromagnetic metal such as steel to permit magnetic attachment of a filter assembly 150 (FIG. 13) as hereinafter described.

Figure 11B:
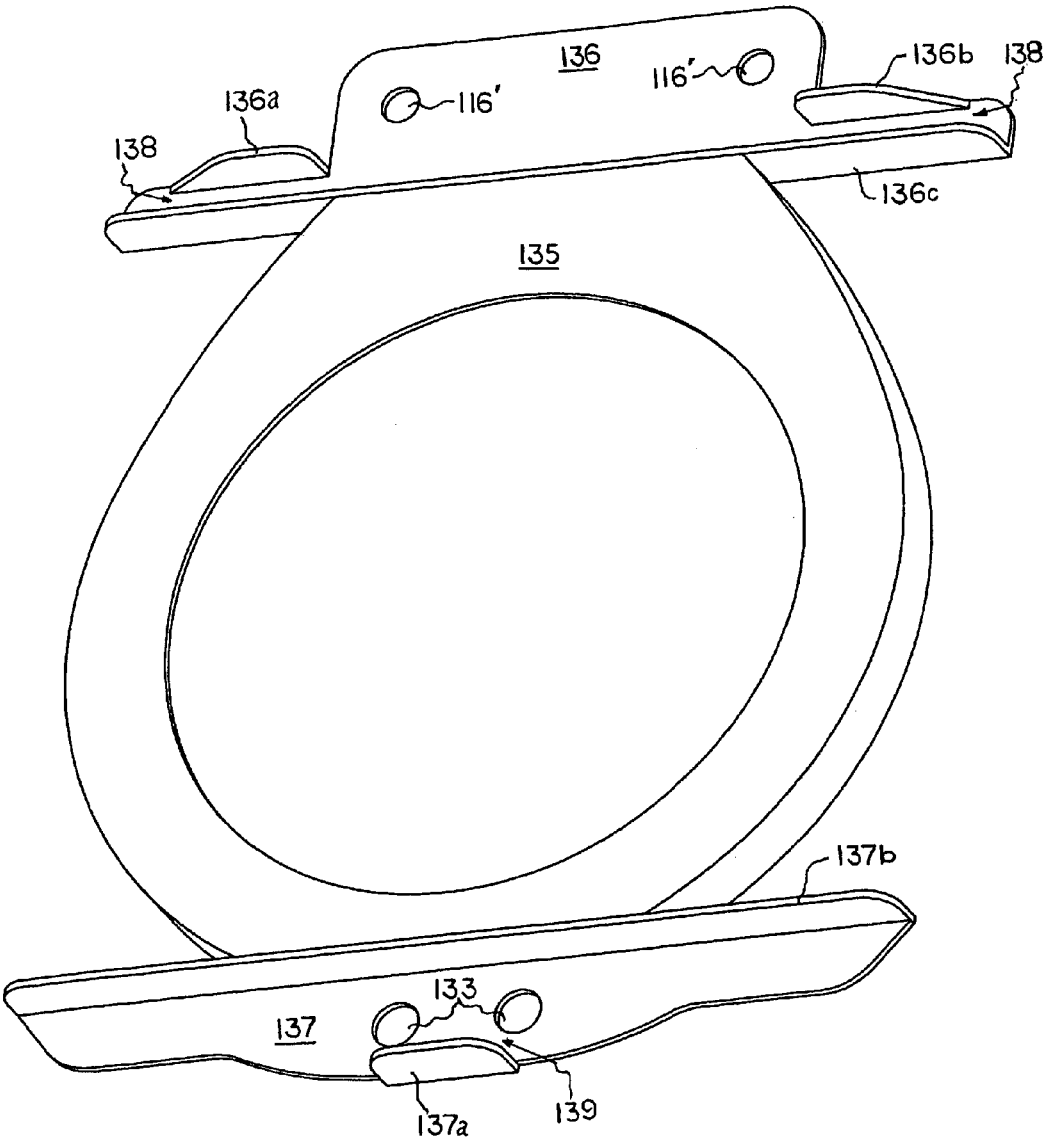
FIG. 11B is a bottom perspective view of the seat adapter bracket of FIG. 10A showing further details thereof.

As most clearly shown in FIG. 11B bracket 136 includes perpendicular members 136*a*, 136*b*, 136*c* which are arranged in a generally parallel relation forming a partial U-shaped channel as at 138 for engagement with rear cross member 202 of the commode frame. Similarly, it can be seen that bracket 137 includes perpendicular members 137*a*, 137*b* arranged in generally parallel relation forming a partial U-shaped channel as at 139 for engagement with front cross member 201 of the commode frame.

It will be appreciated by those skilled in the art that the linear distance 'D' between members 136*c*, 137*a* (FIG. 10A) is calculated to a predetermined dimension to enable engagement with the supporting frames (e.g. cross members 201, 202) of several different portable commodes 200 currently available on the market and, thus, can be retrofitted to many existing commodes or, alternatively, can be utilized in manufacture of new portable commodes 200.

Figure 6:
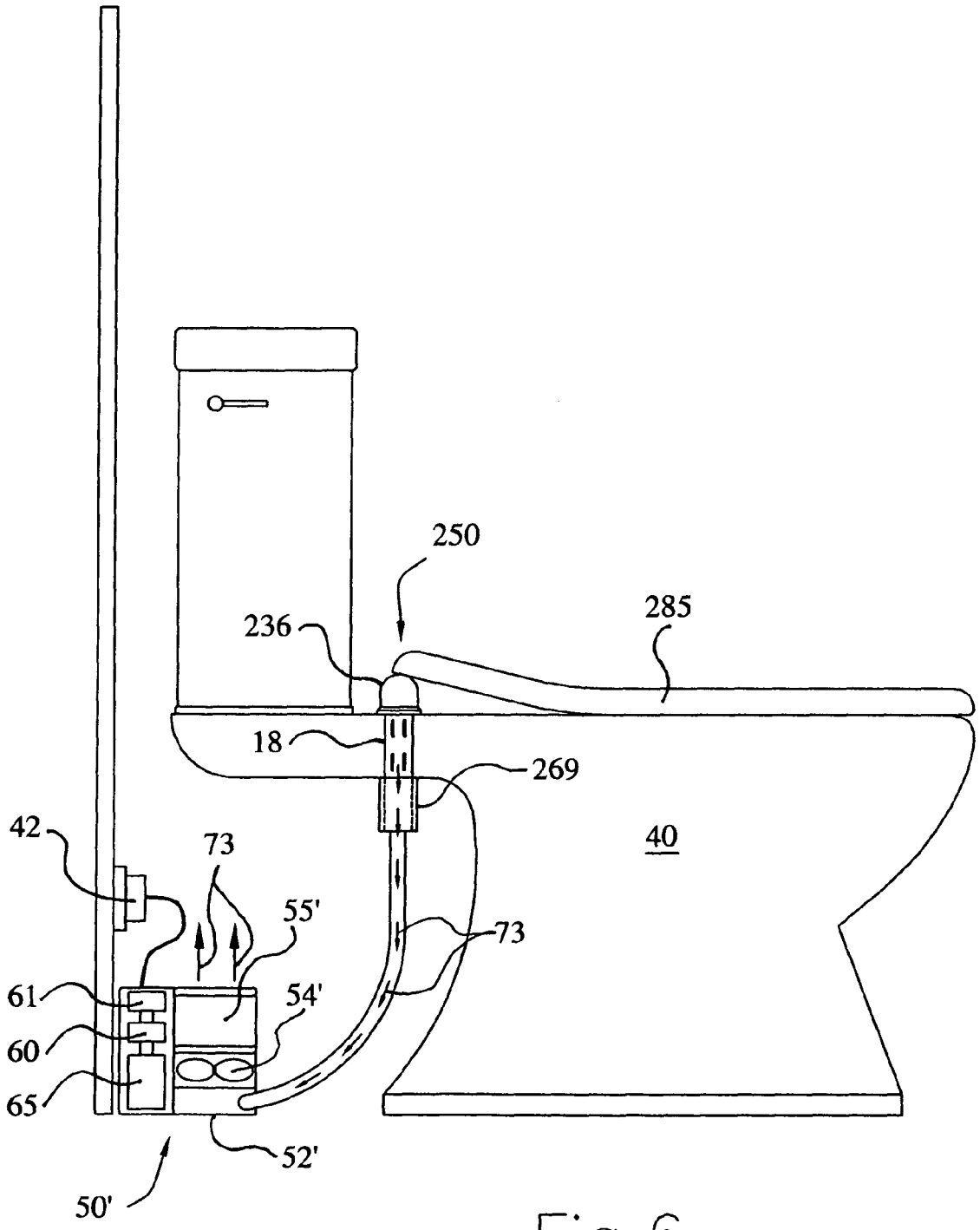
FIG. 6 is a side elevation view of another embodiment of the present toilet seat hinge system shown in FIG. 14 mounted on a toilet in accordance with the present invention.

The exhaust of noxious gases from commode 200 can be carried out of the building via hinge assembly 110' by connective tubing 32 attached to fan 54 which, in turn, directs the exhaust flow to a suitable exhaust conduit 45 as shown in FIG. 4 or by use of the filtration assemblies 50, 50' as shown and described in relation to FIGS. 5 and 6 hereinabove.

Figure 12:
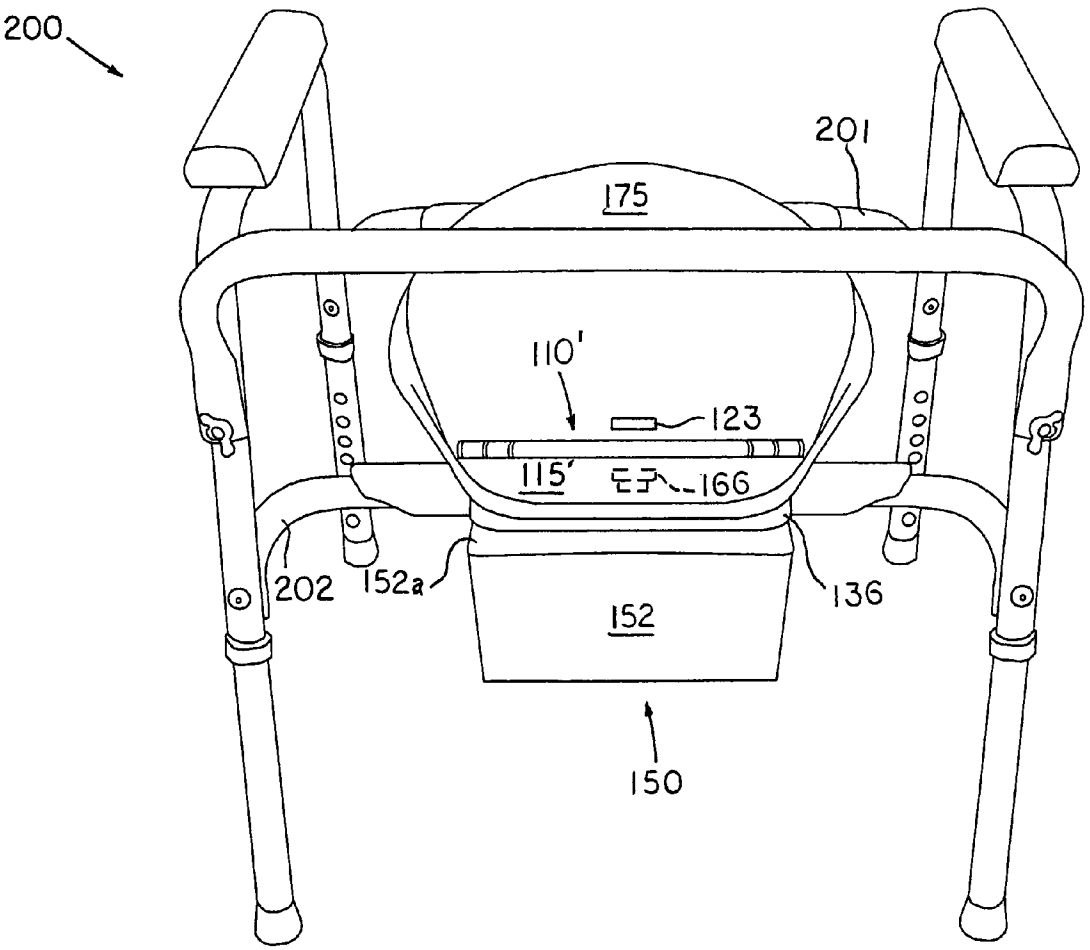
FIG. 12 is a rear perspective view of a portable commode having a toilet seat hinge assembly of FIG. 10A together with a magnetically detachable air filtration assembly of the present invention installed thereon.

In an alternative embodiment shown in FIG. 12, the air and noxious gases are drawn into an air filter assembly, indicated generally at 150, including an enclosure 152 mounted in detachable engagement with hinge assembly 110'. Filter assembly 150 is connected in fluid communication and in alignment with two plastic bolts 18' (FIG. 10A) by attachment to rear extension bracket 136 of plate 135 by permanent magnets 177 installed in a top surface 152*a* of enclosure 152 as shown in FIG. 13.

Figure 13:
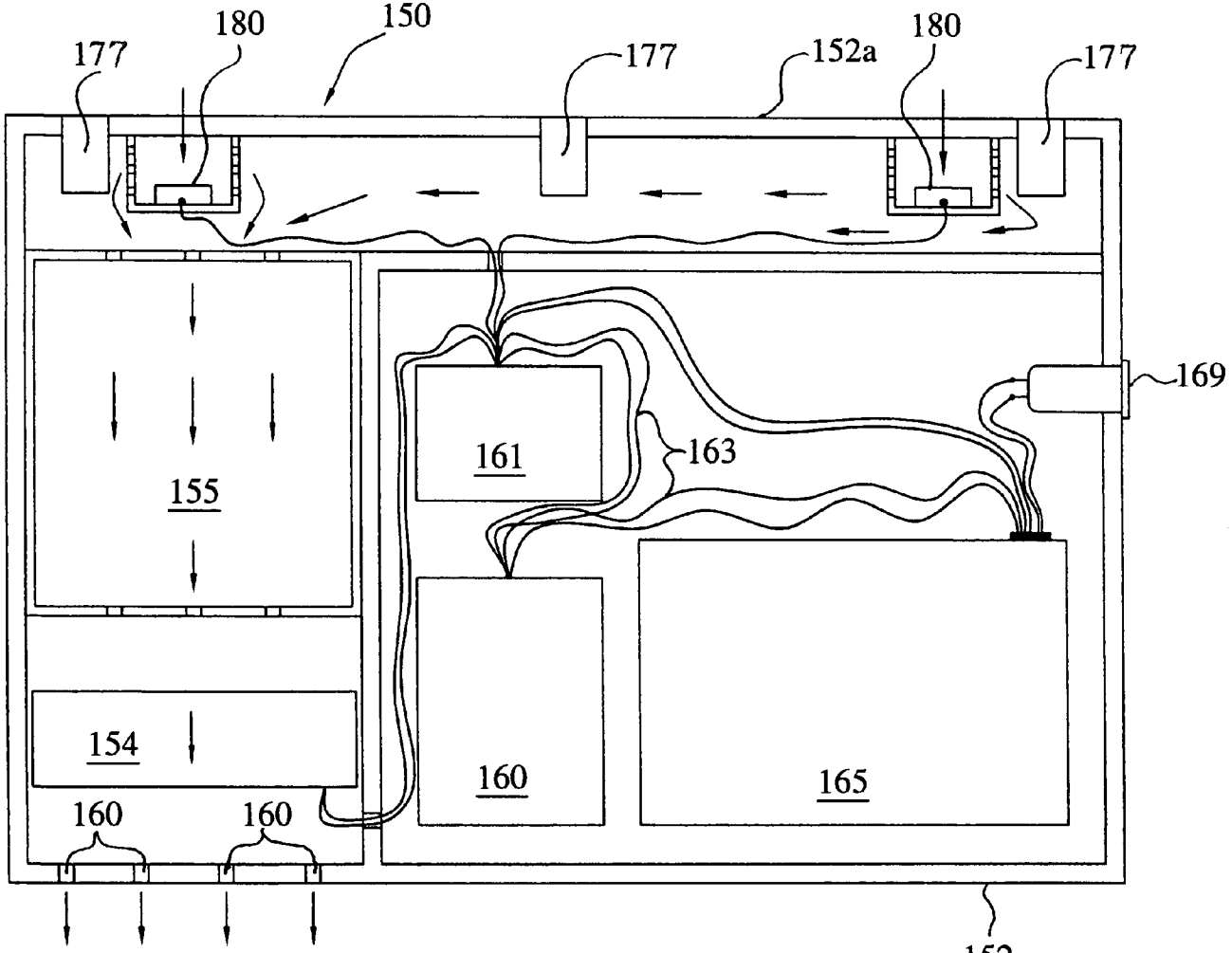
FIG. 13 is an enlarged side elevation view of the air filtration assembly shown in FIG. 12 showing further details thereof.

As more clearly shown in FIG. 13, filter assembly 150 comprises an enclosure 152 which contains an activated charcoal filter element 155. Activated charcoal is a form of carbon that has been processed to make it highly porous and, thus, to provide it with a large surface area available for absorption and/or chemical reactions.

Filter assembly 150 also includes a miniature, brushless fan motor 154 including a radio receiver switch 160 and a battery pack 165 electrically connected to the fan motor. All such components are electrically interconnected to an adjustable timer 161 to control the operating time of the fan motor 154 if seat cover 175 is inadvertently left open after use of the commode 200 to extend the life of the filter element 155.

In one embodiment of the filter assembly 150, fan motor 154 receives power for its operation from a power supply 42 electrically connected to the filter assembly via coaxial power jack 169. Power supply 42 converts AC supplied by a residential electrical system into DC as required to operate the system. A remote control unit 70 of the same type seen in FIG. 7B is positioned within radio communication range of the radio receiver switch 160 (i.e. Model No. YLT-13-1) within the filter assembly 150 to provide remote control of the fan motor 154.

In an alternative operating mode of the filter assembly 150 shown in FIG. 13, fan motor 154 receives power for its operation solely from battery pack 165, which is electrically connected to magnetic switch 166 (FIG. 10B) disposed within housing 115' and the power supply 42 is unplugged from coaxial jack 69 to operate in battery mode. In this operating mode switch 166 is turned to an "ON" position whenever toilet cover 175 is shifted to an open position by a user. In the open condition of the cover 175, permanent magnet 123 and its surrounding magnetic field are shifted into the functional range of switch 166, which automatically actuates fan motor 154. Thereafter, when cover 175 is closed (FIG. 12), permanent magnet 123 and its associated magnetic field are shifted out of functional range relative to switch 166, which is then returned to an "OFF" position and automatically shuts off the fan motor 154.

In the embodiment shown in FIG. 12, it is reiterated that switch 166 is electrically connected by wiring 162 to compression springs 167 (FIG. 10B), which extend into enclosure 152 of the air filter assembly 150 via plastic bolts 18' to contact electrical connectors 180 when air filter assembly 150 is installed as shown. In turn, electrical connectors 180 (FIG. 13) are electrically interconnected by wiring 163 to fan motor 154. Timer 161 operates fan motor 154 for a predetermined period of time in the event that cover 175 is not returned to its closed condition (FIG. 12).

In this embodiment the pathway that air and noxious gases take when the commode 200 is used is that air ingresses from the surrounding room via front inlet 186 and holes 133 (FIG. 10A) into the receptacle 230, mixes with any gases in the receptacle 230, passes through the rear outlet 187 into housing 115' and egresses via at least one hollow bolts 18' into filter assembly 150 (FIG. 13). The air and noxious gases are drawn through filter element 155 by the urging of fan 154 and are discharged from enclosure 152 via openings 160 as shown by directional arrows for recirculation into the ambient air as shown in FIG. 13.

Referring now to FIG. 14 there is shown therein another modified version of the present odor-removing hinge system, indicated generally at 250, in combination with a modified commercial style toilet seat 285, which is used in lieu of a standard commercial toilet seat (i.e. without a seat cover). Such commercial style toilet seats are commonly found in public restrooms and business facilities being well known in the prior art.

In this embodiment hinge system 250 including a so-called split commercial toilet seat 285 in accordance with the present invention is fabricated from an engineered plastic material such as polyvinylchloride (PVC) or other suitable plastic material by an injection molding process. Accordingly, it will be noted that in the embodiment shown in FIG. 14, hinge assembly 250 does not include the plates 19 or arcuate hinge plates 24*a*, 24*b*, 24*c* and 26*a*, 26*b*, 26*c* designed for use with hinge assembly 10, wherein the seat 85 is constructed of wood products. It can also be seen that hinge assembly 250 does not include a housing 15, 115 in the manner of the previously disclosed embodiments.

In lieu of such features hinge assembly 250 comprises a hinge member 267 with a hinge pin hole 267*a* extending through the length thereof as shown. Hinge pin hole 267*a* intersects with a vent passage 255, which is in fluid (i.e. air) transfer communication with the toilet bowl via a rear outlet, indicated generally at 275.

Hinge pin hole 267*a* is configured to receive a hollow hinge pin 263 in mating engagement therein which, in turn, is received in one end of an elbow fitting 236 that mounts the hinge assembly 250 to a top rim of a toilet in an assembled condition of the hinge assembly 250. A hollow, threaded bushing 265 projects from an opposite end of such elbow fitting 236 to receive a threaded, mating coupling 269 for attachment of connective tubing 32 to carry away noxious gases and to secure hinge assembly 250 to the toilet. Alternatively, an elbow fitting 36 (FIG. 3) may be utilized in lieu of coupling 269 to attach tubing 32 (FIG. 4) if preferred.

An opposite end of hinge pin hole 267*a* receives a solid pin 262 which, in turn, is received in one end of an elbow fitting 236 that mounts the hinge assembly 250. A threaded stud 268 projects from an opposite end of such elbow fitting 236 to receive a mating nut 229 to secure the present toilet seat 285 to the toilet.

It will be understood that the exhaust of noxious gases from such a commercial toilet can be carried out of the building via hinge assembly 250 by connective tubing 32 attached to fan 54 which, in turn, directs the exhaust flow to an exhaust conduit 45 (as shown in FIG. 4) or by use of the filtration assemblies 50, 50' as shown and described in relation to FIGS. 5 and 6 hereinabove. It will be appreciated that present toilet seat 285 with the hinge assembly 250 can also be installed on a portable commode 200 using adapter bracket 125 as described hereinabove.

Although not specifically illustrated in the drawings, it should be understood that additional equipment and structural components will be provided as necessary and that all of the components described above are arranged and supported in an appropriate fashion to form a complete and operative odor-removing hinge system for use in combination with a toilet seat and seat cover on toilets and portable commodes incorporating features of the present invention.

Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the claims.

Moreover, although illustrative embodiments of the invention have been described, a latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention. The scope of the present invention is defined by the appended claims.

What is claimed is:

1. An odor-removing hinge system for toilets and portable commodes, said hinge system comprising:

a toilet seat hinge assembly configured for pivoting a toilet seat and a seat cover from an open position to a closed position, wherein said toilet seat hinge assembly includes an upper pair of hinge plates attached to said seat cover, a base plate attached to said toilet and a plurality of arcuate hinge plate segments for adjustable attachment to an underside of said toilet seat, wherein each of said segments is configured for articulating engagement with a mating adjacent segment to adapt said hinge assembly to toilet seats of different configurations, said hinge assembly further comprising an integral housing that defines an internal conduit having an inlet opening and an exhaust opening formed therein, said inlet opening being disposed in fluid communication with a toilet bowl cavity within a toilet, wherein at least one hollow hinge bolt extends from said integral housing in fluid communication with said internal conduit to conduct air and noxious gases from said hinge assembly to an exhaust conduit;

a brushless fan motor disposed in fluid communication with said exhaust opening of said internal conduit enabling said air and noxious gases to be withdrawn from said toilet bowl cavity through said internal conduit and urged to said exhaust conduit; and fan motor actuating means including a power source for automatic operation of said fan motor in said open position of said seat cover, wherein said fan actuating means further includes a magnetically actuated switch disposed within said integral housing for automatic operation of said fan motor each time said seat cover is lifted.

2. The odor-removing toilet seat hinge system of claim 1 wherein said fan motor includes a radio control unit electrically integrated with said fan motor for remote control operation thereof.

3. The odor-removing toilet seat hinge system of claim 1 wherein said fan actuating means further includes a permanent magnet embedded in said seat cover in proximity to said magnetically actuated switch for automatic activation of said fan motor and a timer for operation of said fan motor for a predetermined time cycle each time said seat cover is lifted.

* * * * *